US005418432A

United States Patent [19]

Takeuchi et al.

[11] Patent Number: 5,418,432

[45] Date of Patent: May 23, 1995

[54] VARIABLE COLOR LUMINAIRE

[75] Inventors: Hiroyasu Takeuchi; Katunobu Hamamoto, both of Kadoma, Japan

[73] Assignee: Matsushita Electric Works, Ltd., Osaka, Japan

[21] Appl. No.: 111,236

[22] Filed: Aug. 24, 1993

[30] Foreign Application Priority Data

Aug. 26, 1992 [JP] Japan ..... 4-227593

[51] Int. Cl.[6] ..... H05B 37/02

[52] U.S. Cl. ..... 315/151; 315/152; 315/158; 315/307; 315/317; 250/205

[58] Field of Search ..... 315/151, 152, 156, 158, 315/324, 301, 307, 317; 230/205; 348/798, 799

[56] References Cited

U.S. PATENT DOCUMENTS 3,800,185 3/1974 Anton et al. ..... 315/159
4,037,565 6/1989 White ..... 340/762
4,273,999 6/1989 Pierpoint ..... 315/158

FOREIGN PATENT DOCUMENTS 60-124398 3/1985 Japan .

OTHER PUBLICATIONS

*Microelectronics: Digital and Analog Circuits and Systems,* Millman, Jacob, Ph.D. McGraw-Hill (1979) pp. 571-572, 574, 592, 593.

*Primary Examiner*—Robert J. Pascal
*Assistant Examiner*—Darius Gambino
*Attorney, Agent, or Firm*—Kenyon & Kenyon

[57] ABSTRACT

A variable color luminaire is arranged for controlling a plurality of light sources of different emission colors to be at predetermined dimming levels by means of dimmers, performing a comparison operation to obtain a quantity-of-light ratio and a reference quantity-of-light ratio from detection signals with respect to light outputs of the light sources detected by detectors, and subjecting the light sources to a quantity-of-light correction by means of a corrector according to results of the comparison operation so as to attain a blended color light as set, whereby the resultant blended color light can be prevented from deviating from the set blended color light even when dimming quantity of the respective light sources is close to upper and lower dimming limits.

14 Claims, 38 Drawing Sheets

| FIG. 1A |
|---|
| FIG. 1B |

| |
|---|
| FIG. 2A |
| FIG. 2B |

| FIG. 3A |
| --- |
| FIG. 3B |

| FIG. 4A |
|---|
| FIG. 4B |

| FIG. 6A |
|---|
| FIG. 6B |

| FIG. 7A |
|---|
| FIG. 7B |

| FIG. 8A |
| --- |
| FIG. 8B |

| FIG. 9A |
|---|
| FIG. 9B |

| FIG. 10A |
|---|
| FIG. 10B |

| FIG.11A |
| --- |
| FIG.11B |

| FIG.12A |
| --- |
| FIG.12B |

| FIG. 13A |
| --- |
| FIG. 13B |

| FIG. 14A |
| --- |
| FIG. 14B |

| FIG. 15A |
| --- |
| FIG. 15B |

| FIG. 16A |
|---|
| FIG. 16B |

| FIG. 17A |
|---|
| FIG. 17B |

| FIG.18A |
| --- |
| FIG.18B |

| FIG. 19A |
| --- |
| FIG. 19B |

VARIABLE COLOR LUMINAIRE

BACKGROUND OF THE INVENTION

This invention relates to a variable color luminaire of which luminaire light color is made variable with a plurality of emission colors properly blended.

DESCRIPTION OF RELATED ART

It has been generally attempted to vary human life environment by modulating color temperature of luminaire light. Even in the event of luminaire light in white colors, for example, it is enabled to provide either a cool or warm atmosphere by modulating the color temperature in accordance with ambient temperature, so that the life environment may be improved.

For luminaires realizing the variable color, there has been adopted an arrangement in which three color light sources of red, green and blue are disposed in each device unit and are subjected to a dimming executed by a control section which comprises dimmers respectively inserted between each light source and a power source for controlling dimming level of each light source, and the dimming level of the respective light sources is set by a dimming signal provided from dimming signal generators to the respective dimmers. The arrangement is so made that the dimming signals are provided as based on data of the quantity of light (which shall be referred to as the "quantity-of-light data" hereinafter) into which corresponding relationship between the color temperatures of the luminaire light obtained in a blended color to the dimming level of the respective light sources is set, upon which the quantity-of-light data are stored in a quantity-of-light data memory, and a plurality of pairs of the quantity-of-light data thus stored can be subjected to a selection by an operation of a luminaire light setting means, and the dimming levels of the respective light sources are to be determined. This quantity-of-light data memory comprises normally such memories as RAM, ROM or the like, and three of the quantity-of-light data with respect to every light source are stored in a set for every address. That is, the address is made to correspond to the color temperature, so that the quantity-of-light data corresponding to any desired color temperature can be provided as an output. Accordingly, the luminaire light setting means may be provided for being capable of appointing the address of the quantity-of-light data memory and may comprise an up-down counter and a switch or the like.

Referring more specifically to the foregoing known arrangement, the quantity-of-light data are set as in the followings in practice. That is, assuming that the emission colors of the respective light sources are ($x_R$, $y_R$), ($x_G$, $y_G$) and ($x_B$, $y_B$) on the chromaticity coordinate and the quantity-of-light of the respective light sources is $Y_R$, $Y_G$ and $Y_B$, the emission colors and the quantity-of-light of the luminaire light which are blended will have following relational formulas:

$$x_0=(x_R Yhd R/y_R+x_G Y_G/y_G+x_B Y_B/y_B)/(Y_R/y_R+Y_G/y_G+Y_B/y_B)$$

$$y_0=(Y_R+Y_G+Y_B)/(Y_R/y_R+Y_G/Y_G+Y_B/Y_B/y_B)$$

$$Y_0=(Y_R+Y_G+Y_B)$$

Here, a variation in the ratio of the quantity-of-light of the respective light sources will allow the emission color of the luminaire light obtained in the blended color to be varied, and a variation of the quantity-of-light in a state where the quantity-of-light ratio of the respective light- sources is maintained will allow the quantity-of-light of the luminaire light to be varied. At this time, the quantity-of-light data can be properly prepared in accordance with the emission color of the luminaire light, variable range of the quantity-of-light, specification of the light source and so on.

Here, it is assumed that a plurality of light sources of which the chromaticity coordinates of the emission colors will be (0.5859. 0.3327) for red colors R, (0.3324, 0.5349) for green colors G, and (0.1563, 0.0829) for blue colors B are employed, and that the color temperature is to vary in a range of 2,950 [K] to 6,250 [K]. In this case, the respective light sources have the maximum illuminance on the reference irradiation surface of 110 [1x], 220 [1x] and 30 [1x], and, in an event when the illuminance on the reference irradiation surface by the luminaire light of the blended color is set to be 200 [1x], the dimming level of the respective light sources with respect to the respective color temperatures of the luminaire light will be as in a following Table I:

TABLE I

| | Col.Temp. [K] | Chrmtcty. x | Crdnt. y | Dimmng. Lvl.of Lt. Sorc.[%] R | G | B |
|---|---|---|---|---|---|---|
| Daylight Color | 6,250 | 0.314 | 0.345 | 29 | 69 | 55 |
| White Color | 4,200 | 0.378 | 0.388 | 48 | 70 | 27 |
| Warm White Col. | 3,450 | 0.409 | 0.394 | 67 | 58 | 19 |
| Elec. Lamp Col. | 2,950 | 0.440 | 0.403 | 72 | 54 | 11 |

According to the foregoing known art, however, there arises deviation with respect to the set quantity-of-light due to fluctuation in the light output from the light sources, their variation in characteristics with time and shift in ambient conditions, fluctuation in output characteristics of the dimmer and so on, and eventually the set luminaire light color may also deviate, so as to cause a problem to occur in that the user may feel unpleasant.

In order to eliminate the above problem, there has been adopted such measure that a blended color light is set by a luminaire light setting means and the quantity-of-light data of the light source corresponding to the set value of the blended color light can be read out of the quantity-of-light data memory means. Assuming here that the values of -the quantity-of-light data for the respective light sources are $V_{sr}$, $V_{sg}$ and $V_{sb}$, a pair of the data $V_{sr}$ on the red R and $V_{sg}$ on the green G and another pair of the data $V_{sb}$ on the blue B and $V_{sg}$ on the green G are provided respectively into each of a pair of dividing means, and then outputs of these dividing means will be $V_{sr}/V_{sg}$ and $V_{sb}/V_{sg}$. On the other hand, the quantity-of-light of the respective light sources is detected respectively by a quantity-of-light detecting means, their detection signals are converted by signal converting means to signals $V_{yr}$, $V_{yg}$ and $V_{yb}$ suitable for a comparison operation, then the detected quantity-of-light values $V_{yr}$ and $V_{yg}$ for the red color and green color light sources are input into one of the dividing means, while the also detected quantity-of-light values $V_{yb}$ and $V_{yg}$ of the blue color and green color light sources are input into the other dividing means, whereby respective outputs $V_{yr}/V_{yg}$ and $V_{yb}/V_{yg}$ of these dividing means are input respectively into each of a pair of comparison operation means. Preferably, these comparison operation means comprise respectively a differential comparison circuit, and output signals $V_{01}$ and $V_{02}$ of these comparison operation means will be as following equations:

$$V_{01}=a\times(V_{yr}/V_{yg}-V_{sr}/V_{sg})$$

$$V_{02}=a\times(V_{yb}/V_{yg}-V_{sb}/V_{sg})$$

wherein $a\geqq 1$. These output signals $V_{01}$ and $V_{02}$ are input into a quantity-of-light data correction means to be thereby corrected to the quantity-of-light data $V_{sr}$ and $V_{sb}$, and such output signals as follows are provided:

$$V_{sr}'=V_{sr}-a\times(V_{yr}/V_{yg}-V_{sr}V_{sg})$$

$$V_{sb}'=V_{sb}-a\times(V_{yb}/V_{yg}-V_{sb}V_{sg})$$

Here, the quantity-of-light data subjected to the correction are provided to dimming signal generating means to be subjected to a regulation of quantity-of-light, the quantity-of-light data are reproduced at a high fidelity, and the light of the blended color light conforming to the set value can be obtained. Further, in an event where the quantity-of-light in conformity to the quantity-of-light data cannot be obtained due to any reduction in the quantity-of-light caused by the variation with time or the like, the correction of the quantity-of-light ratio carried out with the quantity-of-light of the green color G made as the center prevents any deviation from occurring in the emission color of the blended color light. When, for example, the setting is made to the color temperature 2,950[K] of electric lamp color, the quantity-of-light data shown by the dimming ratio of the light sources of the red colors, green colors and blue colors will be 72%, 54% and 11% as will be clear from TABLE I, upon which the respective quantity-of-light of red, green and blue colors on the reference radiation surface will by 79.2 [1*x*], 118.8 [1*x*] *and* 3.3 [1*x*]. Provided here that the light source of the green emission color only, for example, attaining just 80% of the quantity-of-light with respect to the set quantity-of-light by means of the quantity-of-light data due to the reduction in the quantity-of-light, the quantity of green color light will become $118.8\times 0.8=95.04$ [1*x*] and, if this quantity is used as it is, there should arise a deviation in the blended emission color from the set value. Provided here that the quantity-of-light of the red and blue colors as corrected through the foregoing correcting operation of the quantity-of-light ratio is made to be $E_R$ and $E_B$, then $E_R=79.2\times 95.04./118.8=63.36$ [1*x*] *and* $E_B=3.3\times 95.04/118.8=2.64$ [1*x*], and the quantity-of-light data in the red and blue colors may be deemed to have been corrected respectively to 57.6% and 8.8%.

According to the foregoing known measure, however, it has been extremely difficult to have the quantity-of-light data corrected to values less than 10% in an event where the lower dimming limit of the dimming means is 10%, for example, there occurs inevitably a color deviation in the blended color light. In order that, in this event the correction will not be made to a value below the lower dimming limit of the dimmer, taking into account the reduction in the quantity-of-light due to any affection of the variation with time or the like in the luminaire in which the ratio of the respective quantity-of-light of the red, green and blue colors, it is necessary that the dimming range to be used as the respective quantity-of-light data of the red, green and blue color light is made to be about 20 to 100% irrespective of ordinary dimming range of 10 to 100% as inherent property of general dimmers, and the quantity-of-light data which does not employ the entire range of the inherent dimming range are set.

When, as has been described above, the dimming range to be used as the quantity-of-light data, in particular, part of the range adjacent to the lower limit of the dimming is set to have a margin so as to carry out the dimming in the range of 20 to 100%, it becomes impossible to obtain the emission color of a color temperature less than 3,450[K] at which the dimming level of the blue color becomes less than 20%. Consequently, in the foregoing known measure, there are involved such problems that:

a) In the luminaire which stores the quantity-of-light data employing the whole dimming range of the dimmer, there arises a risk that the dimmer cannot be regulated to the dimming ratio below the lower dimming limit of the dimmer itself, in an event where the emission color is regulated on the basis of the detection of the quantity-of-light, and the blended color light cannot be regulated to the set emission color.

b) When the luminaire is limited in the dimming range so as not to use the entire dimming range in order to avoid the above problem a), then the variable range of the blended color light has to be made narrower.

c) When, on the contrary to the above b), the color temperature is set to be further higher than the daylight color (6,250[K]), for example, to be 10,000[K], 20,000[K] or the like, the dimming level of the blue color light source rises to a value closer to 100%. Further, in an event where the color temperature is set to be lower than the electric lamp color (2,950[K]) to be 2,800[K], 2,700[K] or the like, then the dimming level of the red color light source rises to be a value close to 100%. When, at this time, the green color light source provides a more quantity-of-light than the set quantity-of-light due to any fluctuation in the luminous flux, the blended color light is caused to deviate from the set value, and a correction of this respect requires that the dimming level is elevated in respect of the red and blue color light sources concurrently. However, the dimming of the red and blue color light sources has already reached the upper limit of 100% and can no more be raised, and there arises a problem that the blended color light cannot be regulated to the set emission color.

For an arrangement relatively close to the foregoing known measure, it will be possible to enumerate one which has been described in Japanese Patent Laid-Open Publication No. 60-124398 by K. Ban.

SUMMARY OF THE INVENTION

A primary object of the present invention is, therefore, to provide a variable color luminaire which eliminates the foregoing problems, and which allows the quantity-of-light data capable of fully employing the whole dimming range to be prepared without causing the variable color range of the blended color light to be narrowed as restricted by the lower and upper dimming limits of the dimmer, and is capable of preventing any deviation of the blended color light from that of set value even when a dimming quantity of the light sources by virtue of the emission color correction is close to the lower or upper dimming limit.

In order to realize the above object, according to the present invention, a variable color luminaire in which a plurality of light sources of different emission colors are controlled by a dimming means, the quantity-of-light data determinative to dimming quantity of the light sources as well as the dimming quantity of the respective light sources corresponding to emission color and quantity-of-light of a blended color light are stored in a memory means, light outputs of the respective light sources are detected by a detecting means, set quantity-of-light of the respective light sources and detected quantity-of-light as detected by the detecting means are compared at a comparison operation means, the quantity-of-light of the respective light sources is corrected at a correction means in accordance with operational results at the comparison operation means, and the luminaire light is thereby made variable in the emission color and quantity-of-light, is characterized in that, except for one of the light sources, the quantity-of-light of other light sources is subjected to an increase and reduction so as to execute the dimming through a convergence discrimination means until a convergence to a predetermined range is attained.

Other objects and advantages of the present invention shall be made clear in following description of the invention detailed with reference to accompanying drawings.

Figure 1A:
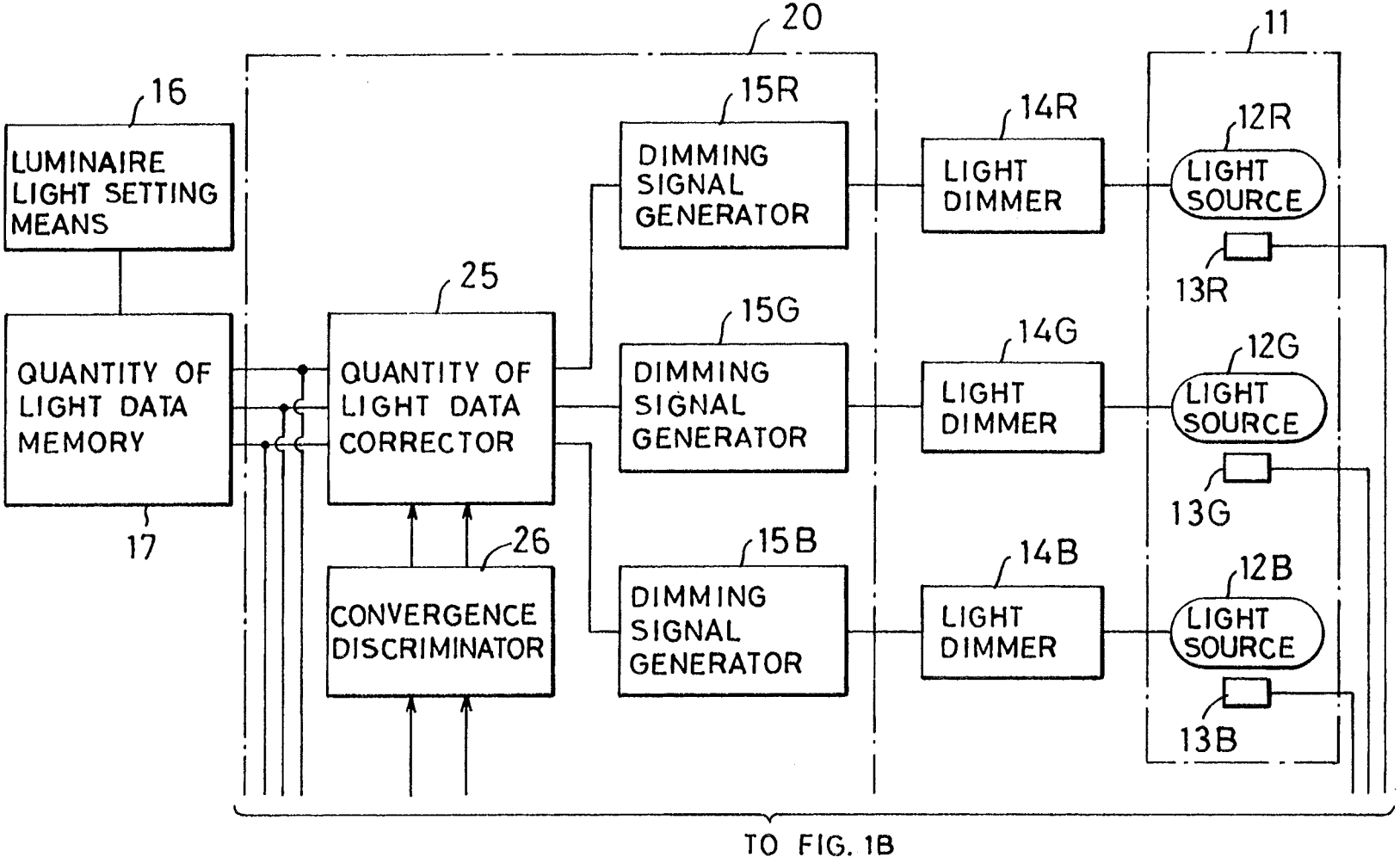
FIG. 1 consisting of the combination of FIGS. 1A and 1B is a block diagram showing an embodiment of the variable color luminaire according to the present invention.

It should be appreciated here that, while the invention should be described with reference to the embodiments shown in the drawings, the intention is not to limit the invention only to the embodiments shown but rather to include all alterations, modifications and equivalent arrangements possible within the scope of appended claims.

DETAILED DESCRIPTION OF THE PREFERRED EMBODIMENTS

Figures 1, 1B:
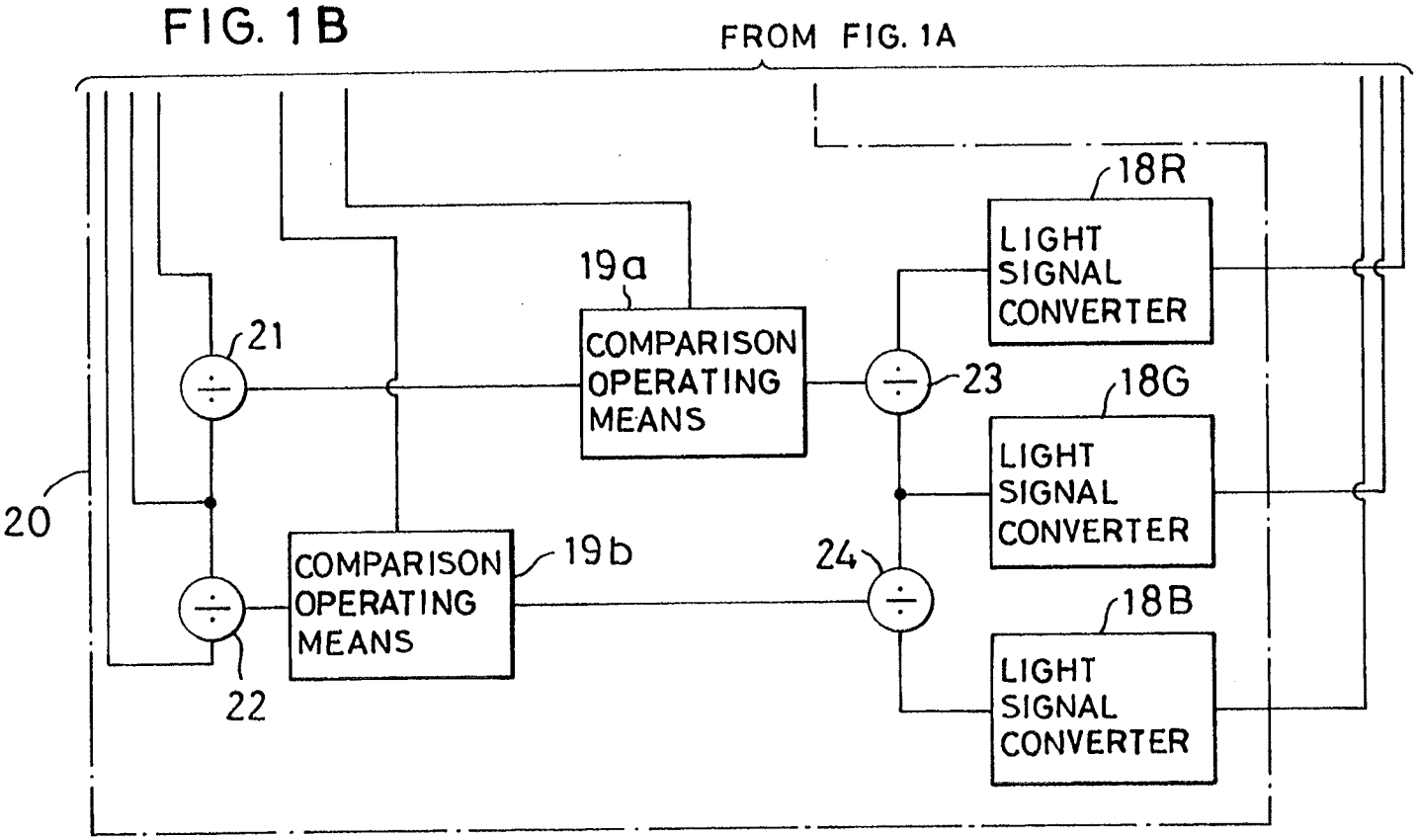

Referring here to FIG. 1, a luminaire equipment 11 of the variable color luminaire according to the present invention comprises light sources 12R, 12G and 12B of mutually different emission colors, and quantity-of-light detectors 13R, 13G and 13B are respectively disposed adjacent to each of the light sources 12R, 12G and 12B. These detectors 13R, 13G and 13B respectively consist preferably of a photodiode, CdS or the like, so that the quantity-of-light of the light sources 12R, 12G and 12B will be successively detected. To the respective light sources 12R, 12G and 12B, light dimmers 14R, 14G and 14B are connected so that the dimming operation will be carried out with dimming signals received from a correction operating means 20. In practice, the correction operating means 20 comprises dimming signal generators 15R, 15G and 15B connected respectively to each of the dimmers 14R, 14G and 14B, and dimming signals for controlling the respective light sources 12R, 12G and 12B to be at optional levels are provided from these dimming signal generators 15R, 15G and 15B.

The variable color luminaire includes a luminaire light setting means 16, for which any arrangement that can appoint addresses of a quantity-of-light data memory 17, such as an up-down counter, switch or the like, may be properly employed, so that predetermined luminaire light color and its quantity-of-light will be set. The quantity-of-light data memory 17 comprises such memory elements as ROM's, in which the data preliminarily computed through a theoretical formula for dimming the respective light sources 12R, 12G and 12B at each of predetermined levels with respect to every address of ROM's in order to obtain the luminaire light of desired emission color are stored in sets respectively for the three colors of R, G and B.

The correction operating means 20 further includes light signal converters 18R, 18G and 18B which convert output signals of the quantity-of-light detectors 13R, 13G and 13B into operated signals. Two comparison operating means 19*a* and 19*b* are connected respectively to each pair of dividers 21 and 23 as well as 22 and 24 to receive their output signals to operate a differential amplification. Further, the correction operating means 20 also comprises a quantity-of-light data corrector 25 and a convergence discriminator 26. At the dividers 21 and 22, and R/G operation and a B/G operation of the quantity-of-light data are carried out for preparing reference quantity-of-light ratios to be used upon operation of a quantity-of-light correction, whereas at the dividers 23 and 24 an R/G operation and a B/G operation of the detection signals are carried out to prepare detected quantity-of-light ratios. Thus the quantity-of-light data corrector 25 carries out a comparison operation of the reference quantity-of-light ratios and the detected quantity-of-light ratios of R/G and B/G, and provides as outputs corrected quantity-of-light data with the respective quantity-of-light data on R, G and B corrected. At the convergence discriminator 26, a convergence of the detected quantity-of-light ratios with respect to the reference quantity-of-light ratios is discriminated.

Figure 2A:
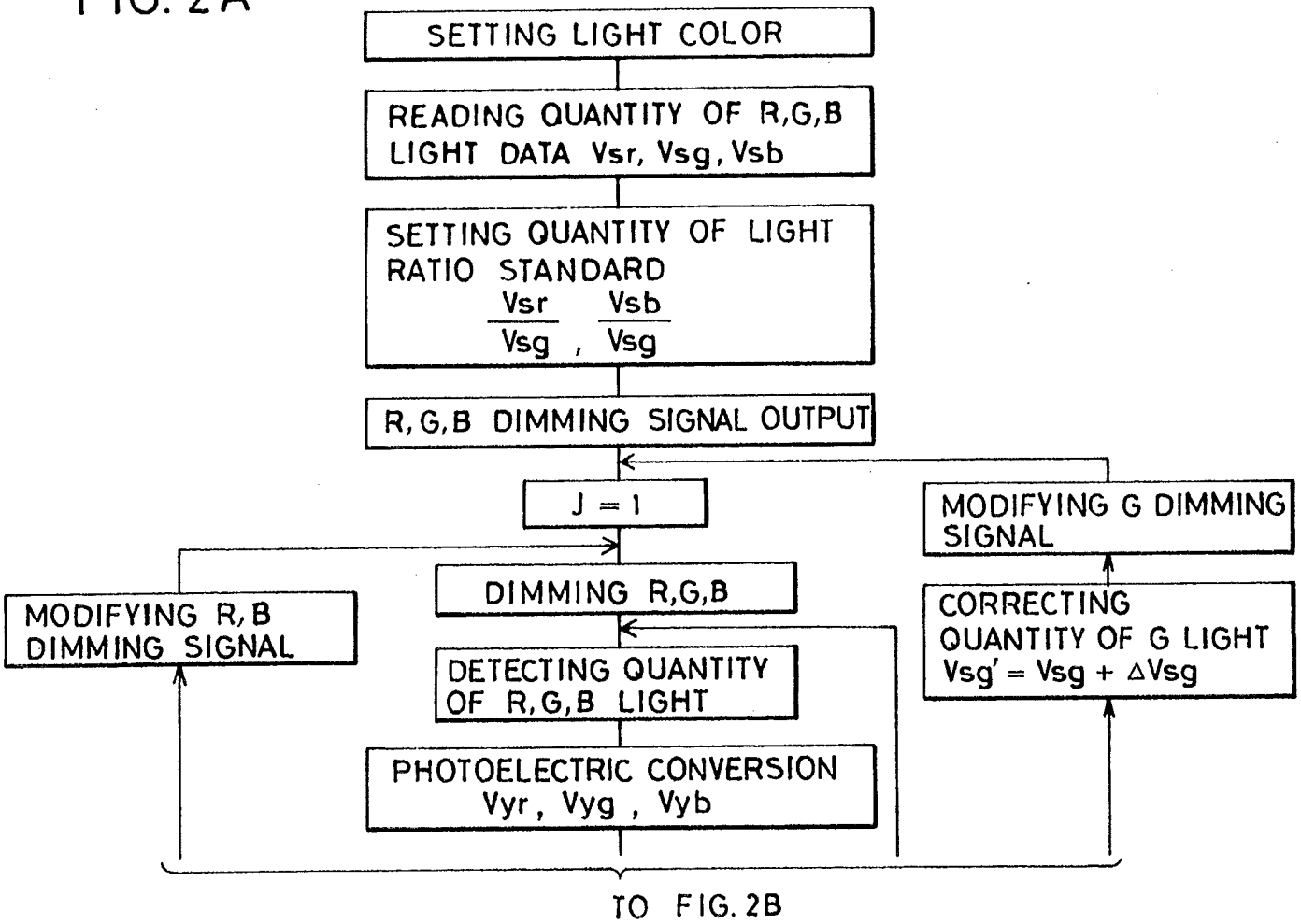
FIG. 2 consisting of the combination of FIGS. 2A and 2B is a flow-chart of the operation of the luminaire of FIG. 1.
Figures 2, 2B:
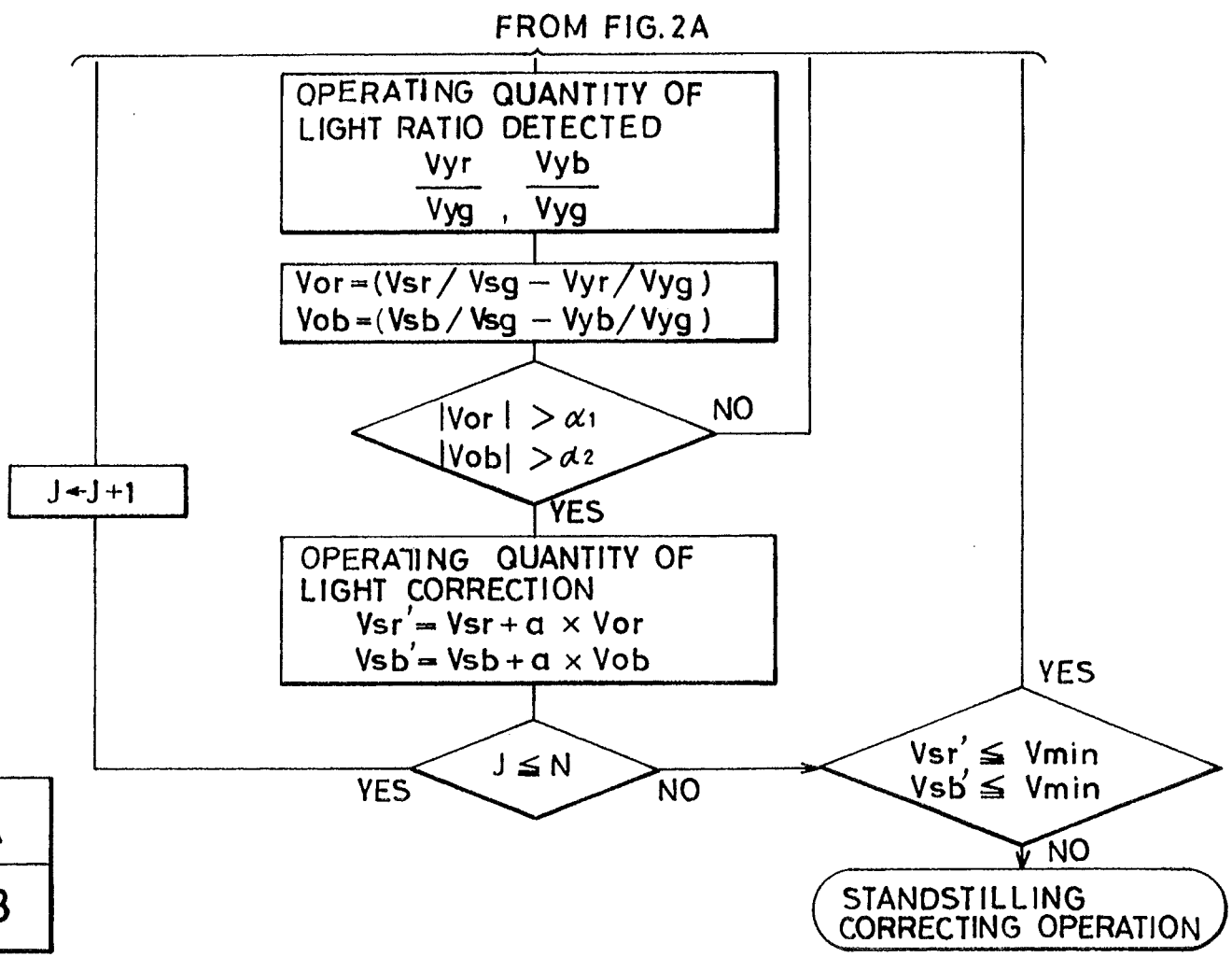

The variable color luminaire shown in FIG. 1 is featured in an arrangement of the quantity-of-light data corrector 25, and the operation of this corrector shall be explained in conjunction with FIG. 2. At the luminaire light setting means 16, a predetermined emission color is set, and the respective quantity-of-light data on R, G and B and stored in the quantity-of-light data memory 17 as set emission colors are read out. Provided here that these quantity-of-light data are $V_{sr}$, $V_{sg}$ and $V_{sb}$, these data are provided to the dividers 21 and 22 to be subjected to a setting operation of the reference quantity-of-light ratio, and data $V_{sr}/V_{sg}$ and $V_{sb}/V_{sg}$ are obtained. On the other hand, the quantity-of-light data $V_{sr}$, $V_{sg}$ and $V_{sb}$ are input to the quantity-of-light data corrector 25 and thereafter to the respective dimming signals generators 15R, 15G and 15B, which generators provide dimming signals for causing the respective light sources 12R, 12G and 12B to provide the quantity-of-light determined by the quantity-of-light data $V_{sr}$, $V_{sg}$ and $V_{sb}$, and the respective light sources 12R, 12G and 12B can be dimmed by such dimming signals. Real quantity-of-light emitted by the light sources 12R, 12G and 12B are detected by the respective quantity-of-light detectors 13R, 13G and 13B and are subjected to photoelectric conversion at the light signal converters 18R, 18G and 18B, of which output signals $V_{yr}$, $V_{yg}$ and $V_{yb}$ are provided, these output signals are input into the dividers 23 and 24 to be subjected to the operation of the detected quantity-of-light ratios, and such data as $V_{yr}/V_{yg}$ and $V_{yb}/V_{yg}$ are obtained. Thereafter, the reference quantity-of-light ratios $V_{sr}/V_{sg}$ and $V_{sb}/V_{sg}$ as well as the detected quantity-of-light ratios $V_{yr}/V_{yg}$ and $V_{yb}/V_{yg}$ are provided respectively into the comparison operating means 19*a* and 19*b*, where the operation for correcting the quantity-of-light is carried out. In these means 19*a* and 19*b*, such comparison operation as (the reference quantity-of-light ratio—the detected quantity-of-light ratio), and their outputs $V_{or}$ and $V_{ob}$ are as follows:

$$V_{or}=(V_{sr}/V_{sg}-V_{yr}/V_{yg})$$

$$V_{ob}=(V_{sb}/V_{sg}-Y_{yb}/V_{yg})$$

These outputs $V_{or}$ and $V_{ob}$ of the comparison operating means 19*a* and 19*b* are input into the convergence discriminator 26, where such discrimination as follows are carried out:

$$|V_{or}|=V_{sr}/V_{sg}-V_{yr}/V_{yg}|>\alpha 1$$

$$|V_{ob}|=V_{sb}/V_{sg}-V_{yb}/V_{yg}|>\alpha 2$$

wherein $\alpha 1$ and $\alpha 2$ are values closer to zero but may be set to values of a level at which any emission color deviation of the blended color light due to a deviation in the quantity-of-light ratio is not recognizable to users. The values $\alpha 1$ and $\alpha 2$ may either be the same value or different values. In an event where $|V_{or}|\leqq\alpha 1$ and $|V_{ob}|\leqq\alpha 2$ in the convergence discriminator 26, no correction of the quantity-of-light data, and a state in which the quantity-of-light is detected is attained. When $|V_{or}|>\alpha 1$, on the other hand, it is discriminated that the correction is required in respect of the dimming quantity of the light source 12R of the red emission color R, and the output $V_{or}$ of the convergence discriminator 26 can be corrected at the quantity-of-light data corrector 25. Assuming that this corrected quantity-of-light data is $V_{sr}'$:

$$\begin{aligned} V_{sr}' &= V_{sr} + a \times V_{or} \\ &= V_{sr} + a \times (V_{sr}/V_{sg} - V_{yr}/V_{yg}) \end{aligned}$$

wherein "a" is a constant. This also applies to the case of $|V_{ob}|>\alpha 2$, and a corrected quantity-of-light data $V_{sb}'$ of the quantity-of-light data $V_{sb}$ will be:

$$\begin{aligned} V_{sb}' &= V_{sb} + a \times V_{ob} \\ &= V_{sb} + a \times (V_{sb}/V_{sg} - V_{yb}/V_{yg}) \end{aligned}$$

These corrected quantity-of-light data $V_{sr}'$ and $V_{sb}'$ are input into the dimming signal generators 15R and 15B, and the dimming signals are modified, so as to correct the dimming quantities of the light sources 12R and 12B of the emission colors R and B. In an event where, at this time, the light source 12G of the emission color G is unable to attain the quantity-of-light set as the quantity-of-light data due to a reduction in the quantity-of-light, then the correction of the dimming quantity of the light sources 12R and 12B of the emission colors R and B is carried out in connection with the quantity-of-light of the above light source 12G but, when the corrected dimming quantities corrected become lower than the lower limit of the dimming range of the dimmers 14R and 14B, it is no more possible to regulate the quantities of light of R and B. In this case, the convergence discrimination carried out at the convergence discriminator 26 should always result in that:

$$|V_{or}|=|V_{sr}/V_{sg}-V_{yr}/V_{yg}|>\alpha 1$$

$$|V_{ob}|=|V_{sb}/V_{sg}-V_{yb}/V_{yg}|>\alpha 2$$

It is assumed here that the frequency of carrying out the correction of the quantity-of-light in respect of the light sources of R and B is "J", while the frequency of discriminating that the quantity-of-light also in respect of the light sources of R and B cannot be regulated is "N". As the frequency J of the quantity-of-light correction with respect to R and B is counted at the quantity-of-light corrector 25 and $J \geqq N$ is reached, the lower dimming limit of R and B is discriminated, and the correction of the quantity-of-light of G is carried out when the dimming is discriminated to be close to the lower limit ($V_{sr}' \leqq V_{min}$ or $V_{sb}' \leqq V_{min}$).

While in the foregoing arrangement the quantity-of-light correction for G is carried out upon discrimination of the lower dimming limit, the all quantity-of-light correction is stopped at the time when R and B are discriminated not to be at the lower limit since, in this event, too, the blended color light involves a color deviation. The corrected quantity-of-light data $V_{sg}'$ of G is made to be $$V_{sg}' = V_{sg} + \Delta V_{sg}$$

that is, $\Delta V_{sg}$ is added to the quantity-of-light data $V_{sg}$ of G, and the dimming signal is modified so as to increase the quantity-of-light of G. Thus, the control is so made that the corrected dimming quantity of R and B will be made higher than the lower dimming limit of the dimmers 13R and 13B. The quantity-of-light of R and B will be repeatedly regulated with respect to the increased quantity-of-light of G, and the respective quantity-of-light correction of R, G and B is carried out until the convergence discriminator 26 discriminates that $$|V_{or}| = |V_{sr}/V_{sg} - V_{yr}/V_{yg}| \leqq \alpha 1, \text{ and}$$

$$|V_{ob}| = |V_{sb}/V_{sg} - V_{yb}/V_{yg}| \leqq \alpha 2.$$

By executing the quantity-of-light correction of the respective light sources in this way, it is possible to obtain the blended color light of the preliminarily set emission color. Further, since no color deviation occurs in the emission color even the quantity-of-light data of the respective light sources of the different colors R, G and B are made to employ the whole of the dimming range of the dimmers 14R, 14G and 14B, the variable emission color range is not caused to be narrowed, and the emission colors of a wide range can be obtained.

While in the foregoing the quantity-of-light correction of G has been referred to as being carried out in the event when the frequency J of the quantity-of-light correction of R and B has reached $J \geqq N$, it is possible to execute the quantity-of-light correction of G in an event where the correction of R and B cannot be executed within a set time t predetermined.

Figure 3A:
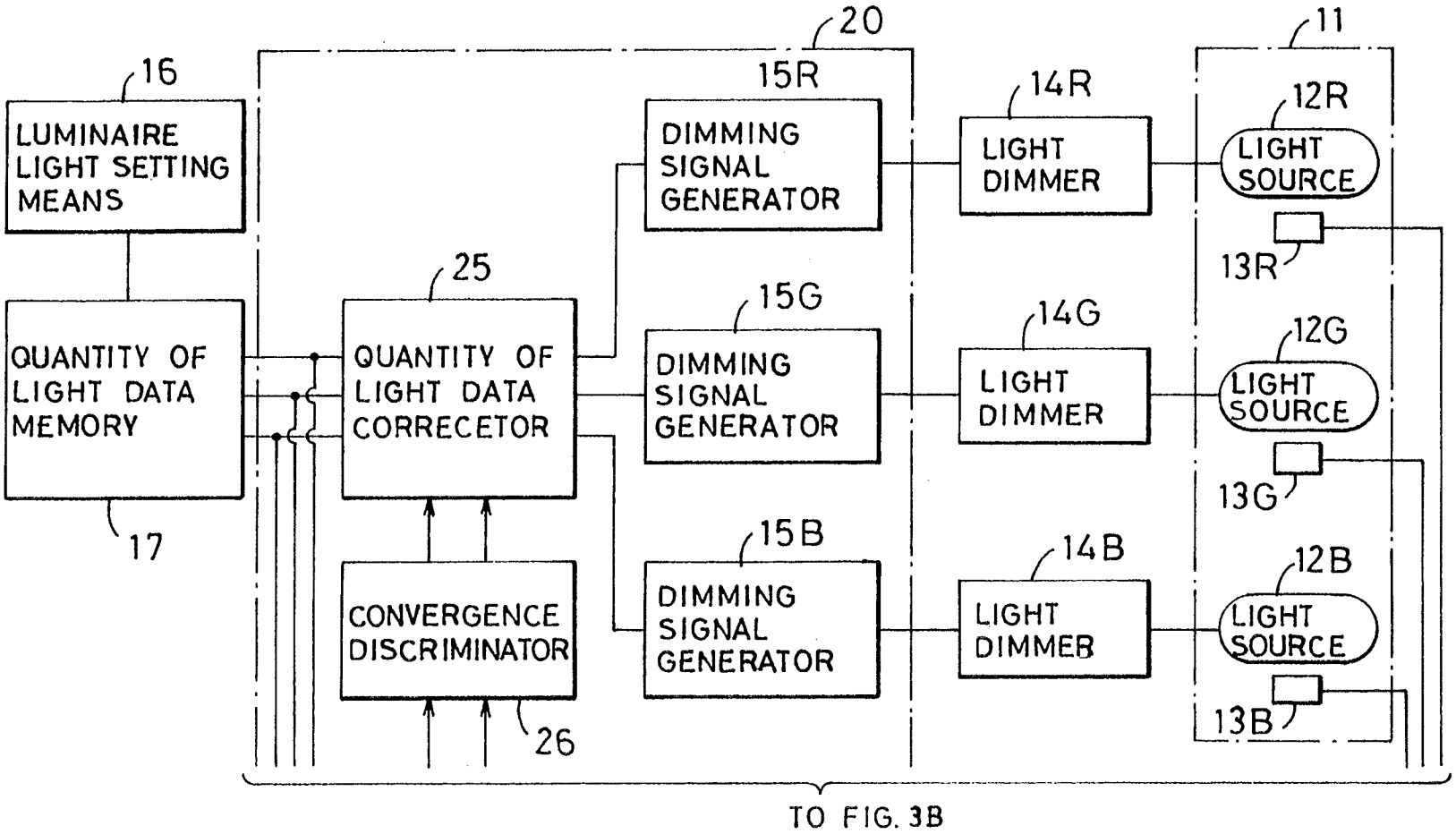
FIG. 3 consisting of the combination of FIGS. 3A and 3B is a block diagram showing another embodiment of the luminaire according to the present invention.
Figures 3, 3B:
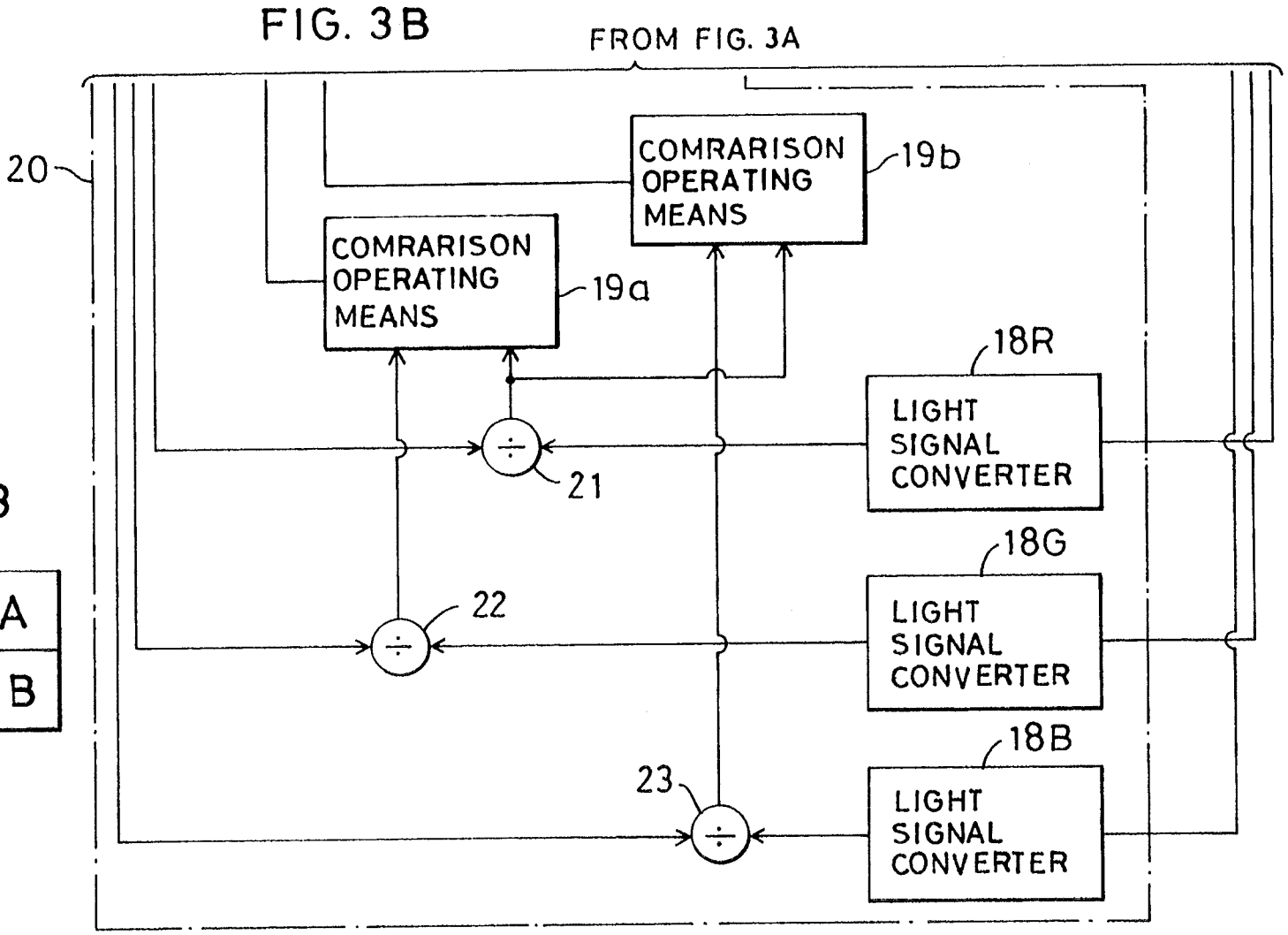
Figure 4A:
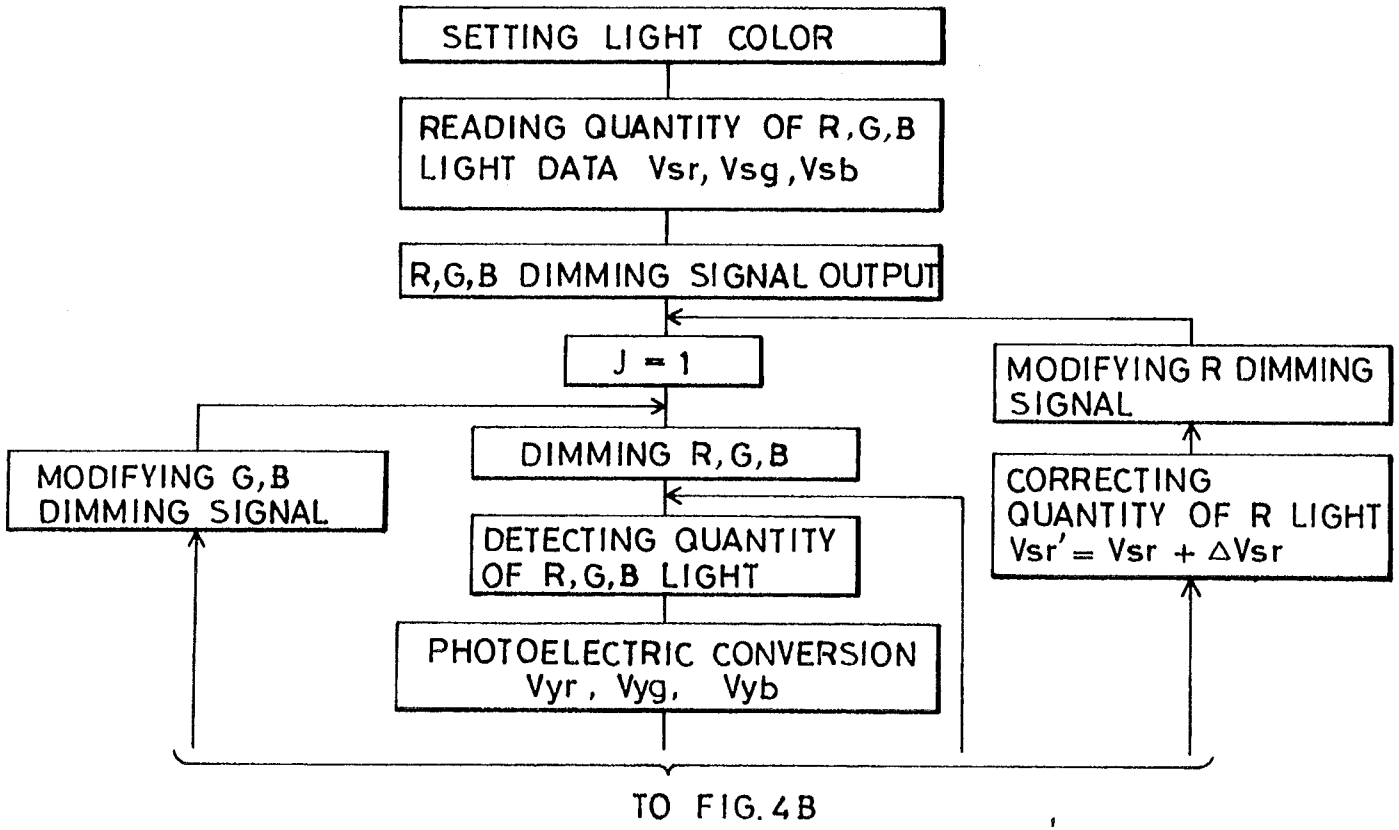
FIG. 4 consisting of the combination of FIGS. 4A and 4B is a flow-chart of the operation of the luminaire of FIG. 3.
Figures 4, 4B:
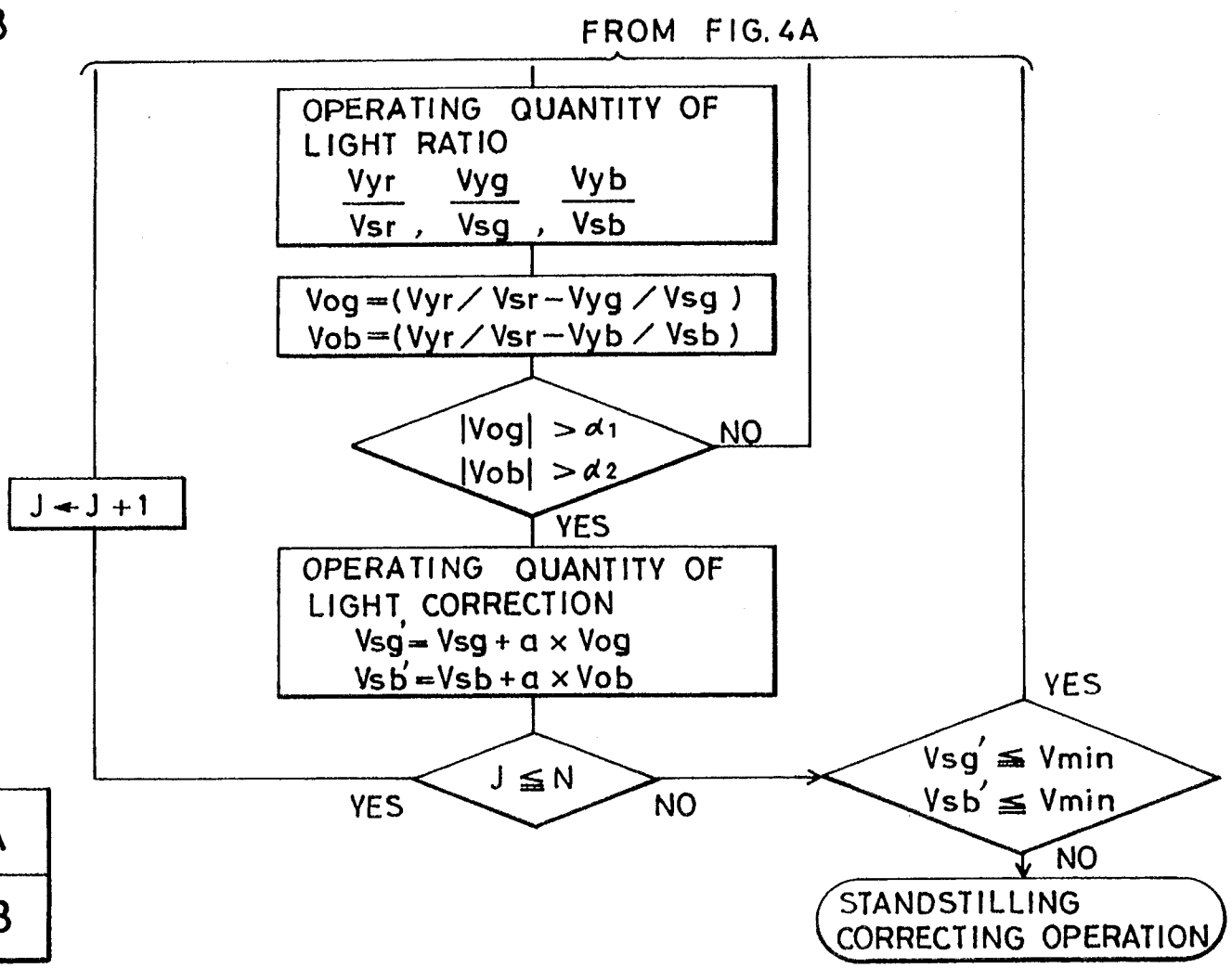

Referring now to FIG. 3, there is shown another embodiment of the luminaire according to the present invention, the operation of which embodiment being shown with a flow-chart of FIG. 4. While the instant embodiment has an arrangement very similar to that of the foregoing embodiment of FIG. 1, differences are present in the manners in which the quantity-of-light ratio is operated and in which the quantity-of-light data of R, G and B are corrected. In the instant embodiment, the quantity-of-light data of the respective light sources 12R, 12G and 12B of R, G and B corresponding to the emission colors set at the luminaire light setting means 16 are read out of the quantity-of-light data memory 17, and the light sources 12R, 12G and 12B of R, G and B are controlled to the predetermined dimming quantity. The quantity-of-light of each of the respective light sources 12R, 12G and 12B is detected at the quantity-of-light detectors 13R, 13G and 13B, and the corresponding detection signals $V_{yr}$, $V_{yg}$ and $V_{yb}$ are provided as outputs of the light signal converters 18R, 18G and 18B. These detection signals $V_{yr}$, $V_{yg}$ and $V_{yb}$ are input respectively of the light signal converters 18R, 18G and 18B. These into corresponding dividers 21, 22 and 23, whereas the of the light signal converters 18R, 18G and 18B. These quantity-of-light data $V_{sr}$, $V_{sg}$ and $V_{sb}$ from the quantity-of-light data memory 17 are also input respectively into each of the dividers 21, 22 and 23, where the quantity-of-light ratio operation is carried out to attain their outputs $V_{yr}/V_{sr}$, $V_{yg}/V_{sg}$ and $V_{yb}/V_{sb}$. First two outputs of the dividers 21 and 22 are input into the comparison operating means **19*a*, and the latter two outputs of the dividers 22 and 23 are input into the other comparison operating means 19*b*. At these comparison operating means 19*a* and 19*b***, the comparison operation of the quantity-of-light ratio is carried out. Assuming that their operation results are $V_{og}$ and $V_{ob}$, they will be $$V_{og} = V_{yr}/V_{sr} - V_{yg}/V_{sg}$$

$$V_{ob} = V_{yr}/V_{sr} - V_{yb}/V_{sb}$$

These outputs of the comparison operating means **19*a* and 19*b* are input into the convergence discriminator 26, where the same convergence discrimination as that in the embodiment of FIG. 1 is carried out. At this convergence discriminator 26, the correction of the quantity-of-light data is not required when $|V_{og}| \leqq \alpha 1$ and $|V_{ob}| \leqq \alpha 2$, and the correction is not carried out. In the case of $|V_{og}| > \alpha 1$, it is discriminated that the correction of the dimming quantity of the light source 12G of the color G is necessary, and the operation result $V_{og}$ of the comparison operating means 19*a* is provided to the quantity-of-light data corrector 25**, where the quantity-of-light data $V_{sg}$ are corrected to be $V_{sg}' = V_{sg} + a \times V_{og}$. The same operation is performed in the event of $|V_{ob}| > \alpha 2$, and the corrected quantity of-light data will be $V_{sb}' = V_{sb} + a \times V_{ob}$.

These corrected quantity-of-light data $V_{sg}'$ and $V_{sb}'$ are provided to the respective dimming signal generators 15R, 15G and 15B, and the dimming signals are modified so as to correct the dimming quantity of the light sources 12G and 12B. Here, as the frequency J of the quantity-of-light correction with respect to G and B becomes $J \geqq N$ and the dimming level of G and B is discriminated to be close to the lower limit, the quantity-of-light of the light source 12R is to be corrected. The corrected quantity-of-light data $V_{sr}'$ of the source 12R will be $V_{sr}' = V_{sr} + \Delta V_{sr}$, and the dimming signal is modified so as to increase the quantity-of-light of the light source 12R. While in the foregoing embodiment of FIG. 1 the correction of the quantity-of-light of G has been made in the event when the emission color correction cannot be attained by the quantity-of-light correction of R and B, it is possible as in the present embodiment to carry out the quantity-of-light correction of R when the emission color correction cannot be attained, as will be readily appreciated. And, in the same manner, it is easily understood that it is possible to carry out the quantity-of-light correction of B, when the emission color correction cannot be attained.

Figure 5A:
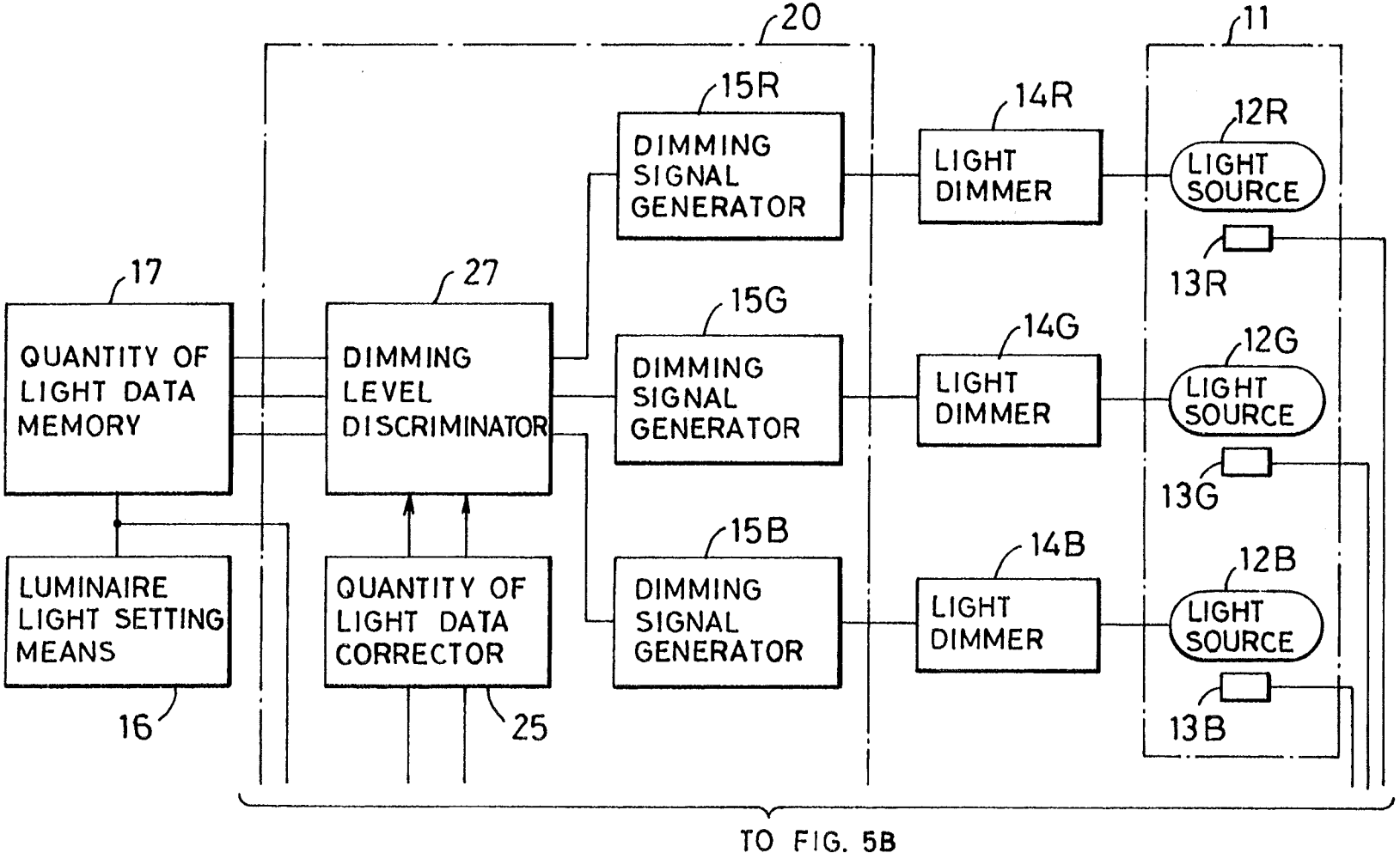
FIG. 5 consisting of the combination of FIGS. 5A and 5B is a block diagram showing a further embodiment of the luminaire according to the present invention.
Figure 5B:
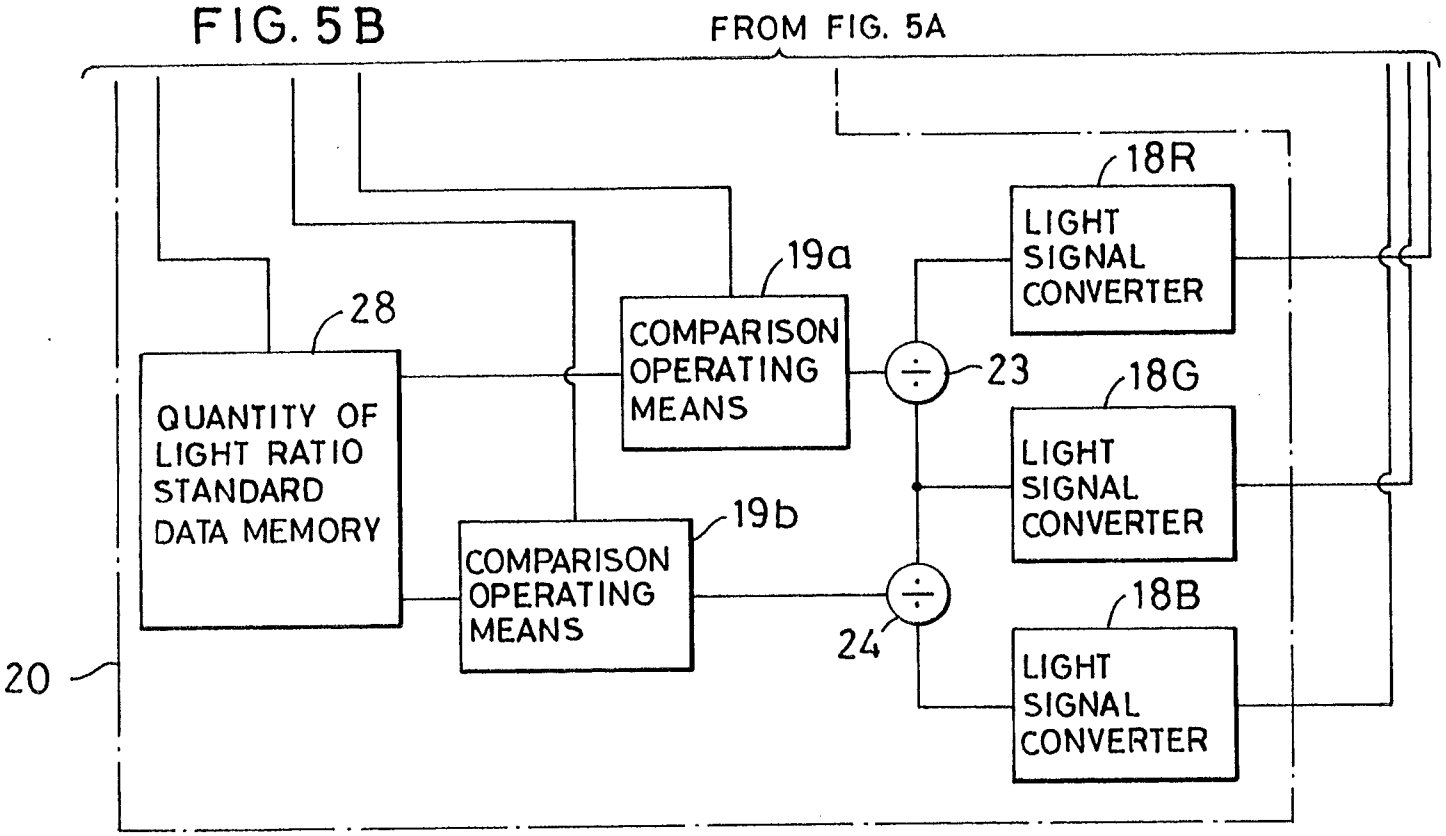
Figure 5:
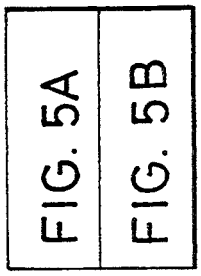
Figure 6A:
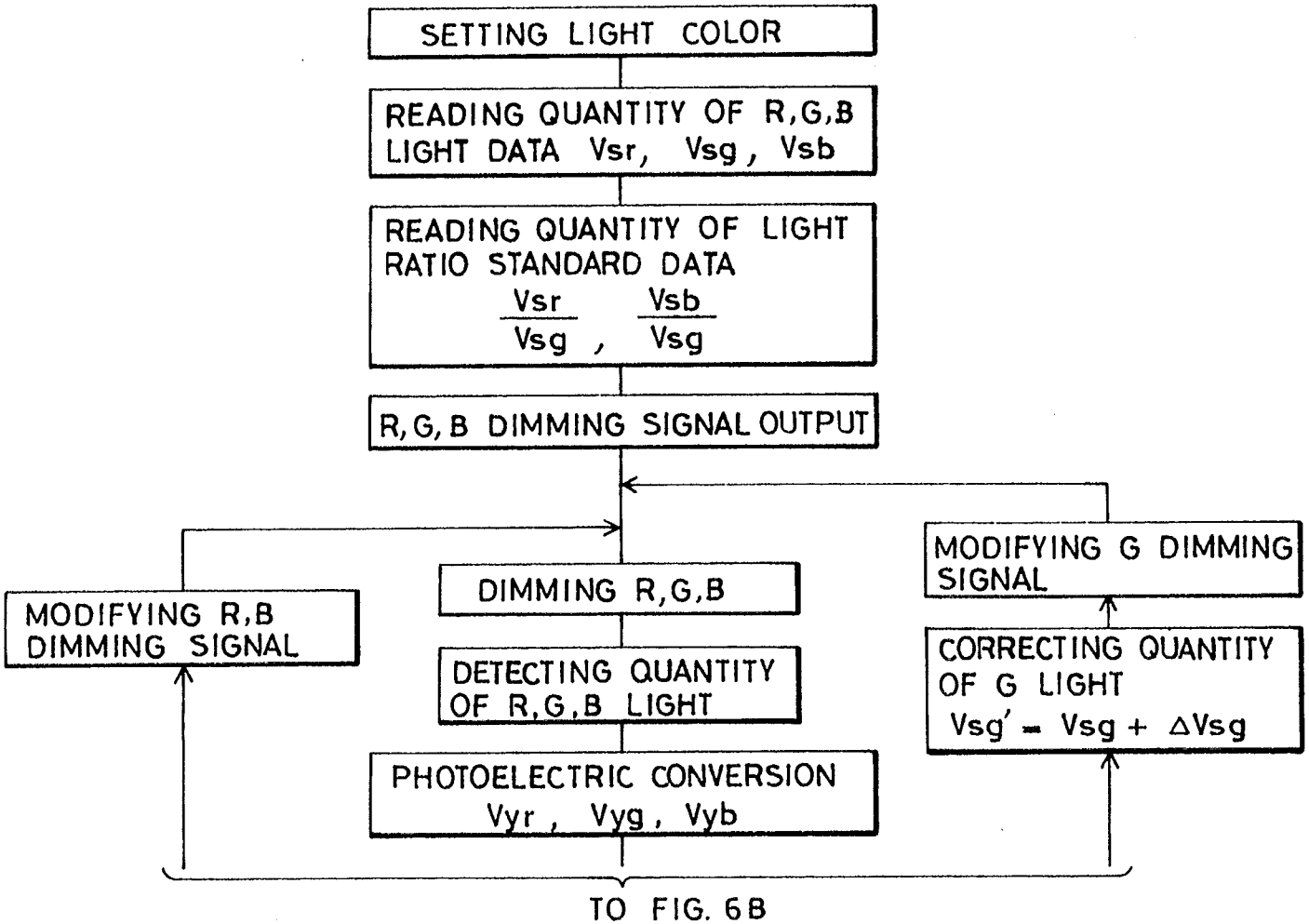
FIG. 6 consisting of the combination of FIGS. 6A and 6B is a flow-chart of the operation of the luminaire of FIG. 5.
Figures 6, 6B:
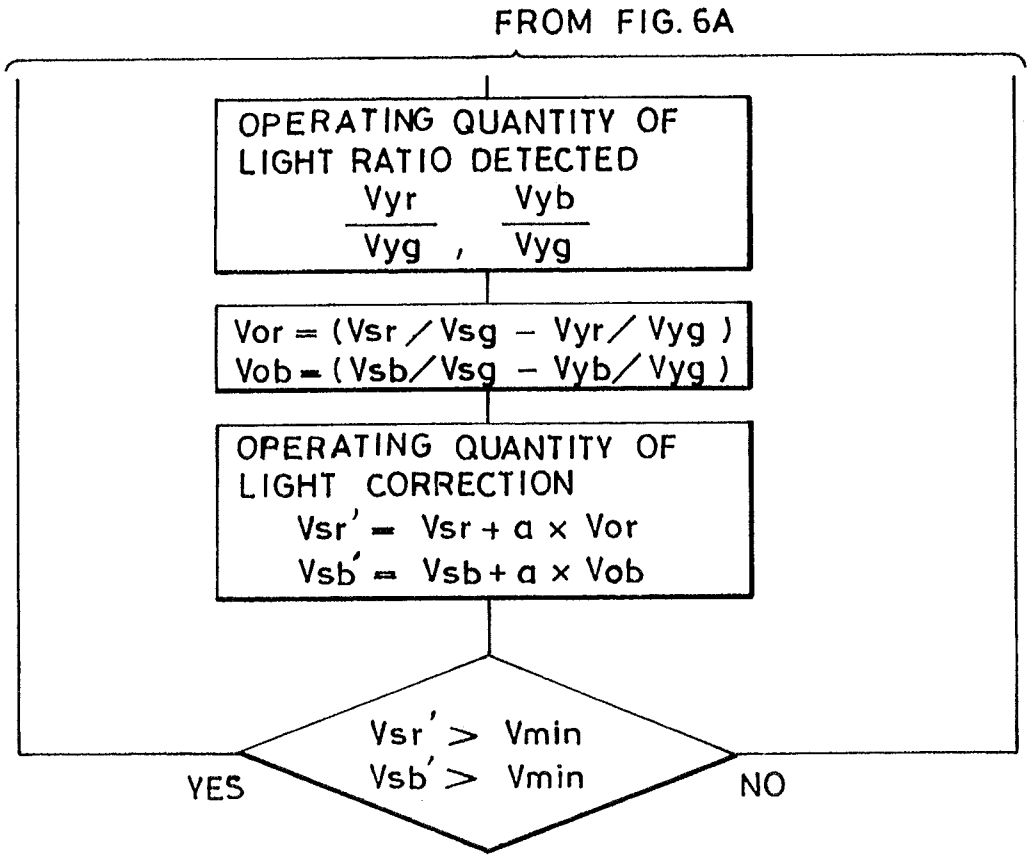

Referring next to FIG. 5, there is shown another embodiment of the present invention, the operation of which is as shown by a flow-chart of FIG. 6. In the present instance, similar to the embodiment of FIG. 1, the quantity-of-light of the respective light sources 12R, 12G and 12B is detected, the detection signals are subjected to the operation for obtaining the quantity-of-light ratio, results of this quantity-of-light ratio operation are compared with the reference quantity-of-light ratio to carry out the quantity-of-light correction of the respective light sources 12R, 12G and 12B, and the emission color correction of the blended color luminaire light is carried out. While in the embodiment of FIG. 1 the reference quantity-of-light ratio has been set to be $V_{sr}/V_{sg}$ and $V_{sb}/V_{sg}$ through the operation carried out with respect to the quantity-of-light data $V_{sr}$, $V_{sg}$ and $V_{sb}$ stored preliminarily in the quantity-of-light data memory 17, the present embodiment is provided with a reference quantity-of-light ratio data memory 27 for preliminarily storing the set reference quantity-of-light ratio $V_{sr}/V_{sg}$ and $V_{sb}/V_{sg}$. This reference quantity-of-light ratio data memory 27 may comprise such memory elements as ROM's similarly to the foregoing quantity-of-light data memory 17, the quantity-of-light data for determining the dimming quantity of the respective light sources 12R, 12G and 12B so as to achieve the set value of the luminaire light are provided out of the quantity-of-light data memory 17 in response to the appointment of the address corresponding to the set value at the luminaire light setting means 16, and the reference quantity-of-light ratio data which are the quantity-of-light ratio of R, G and B in the same colors are provided out of the reference quantity-of-light ratio data memory 27. These reference quantity-of-light data $V_{sr}/V_{sg}$ and $V_{sb}/V_{sg}$ thus provided out of the memory 27 are subjected at the comparison operating means **19*a* and 19*b* to the comparison operation with the operational results $V_{yr}/V_{yg}$ and $V_{yb}/V_{yg}$ of the detection quantity-of-light ratio repectively operated at the dividers 23 and 24, and the quantity-of-light data $V_{sr}$ and $V_{sb}$ of R and B as the result of the above comparison operation are corrected at the quantity-of-light data corrector 25**, so as to be such data $V_{sr}'$ and $V_{sb}'$ as represented by following formulas:

$$V_{sr}'=V_{sr}+a\times(V_{sr}/V_{sg}-V_{yr}/V_{yg})$$

$$V_{sb}'=V_{sb}+a\times(V_{sb}/V_{sg}-V_{yb}/V_{yg})$$

These corrected quantity-of-light data $V_{sr}'$ and $V_{sb}'$ are input into the dimming level discriminator 28, in which the lower limit quantity-of-light value $V_{min}$ corresponding to the lower limit dimming level of the dimmers 14R and 14B employed in the present embodiment is preliminarily stored. The corrected quantity-of-light data $V_{sr}'$ and $V_{sb}'$ are compared with the lower limit quantity-of-light value $V_{min}$ and, when $V_{sr}'\geqq V_{min}$ and $V_{sb}'\geqq V_{min}$, the correction of the luminaire light color is carried out by means of the quantity-of-light correction of R and B in accordance with the corrected quantity-of-light data $V_{sr}'$, and $V_{sb}'$. When the dimming level discriminator 28 discriminates $V_{sr}'<V_{min}$ or $V_{sb}'<V_{min}$, there is carried out the quantity-of-light correction of G. The corrected quantity-of-light data $V_{sg}'$ of G is made to be $$V_{sg}'=V_{sg}+\Delta V_{sg}$$

That is, $\Delta V_{sg}$ is added to the quantity-of-light data $V_{sg}$ of G and the dimming signal is modified so as to increase the quantity-of-light of G. This light increase is continued until $V_{sr}'\geqq V_{min}$ and $V_{sb}'\geqq V_{min}$ are reached. With such correction of R, G and B, it is enabled to obtain the luminaire light involving no deviation with respect to the predetermined emission color. In the present embodiment of FIG. 5, the preliminary storing of the reference quantity-of-light ratio data causes the number of data increased in accordance with the quantity-of-light data, but such operation for obtaining the reference quantity-of-light ratio as required in the embodiment of FIG. 1 is made unnecessary, and the operational treatment can be simplified.

While in the foregoing embodiments of FIGS. 1, 3 and 5 the control has been so made that the respective dimming levels will not be below the lower dimming limit by means of the correction of the quantity-of-light of respective R, G and B, the description shall be made with respect to an arrangement in which the control is so made as not to render the respective dimming levels to be the upper dimming limit.

Figure 7A:
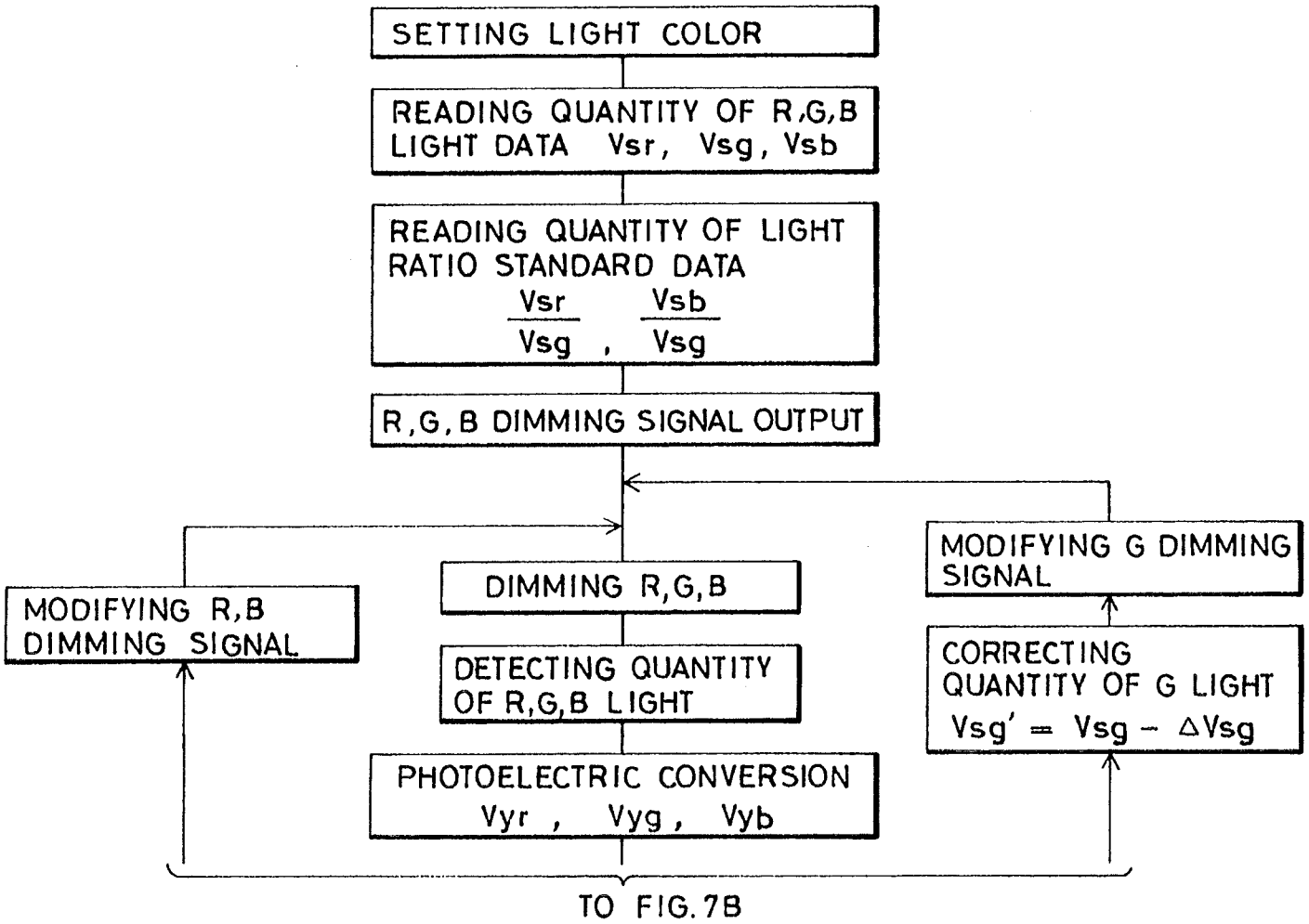
FIG. 7 consisting of the combination of FIGS. 7A and 7B is a flow-chart of the operation another embodiment utilizing the luminaire of FIG. 5.
Figures 7, 7B:
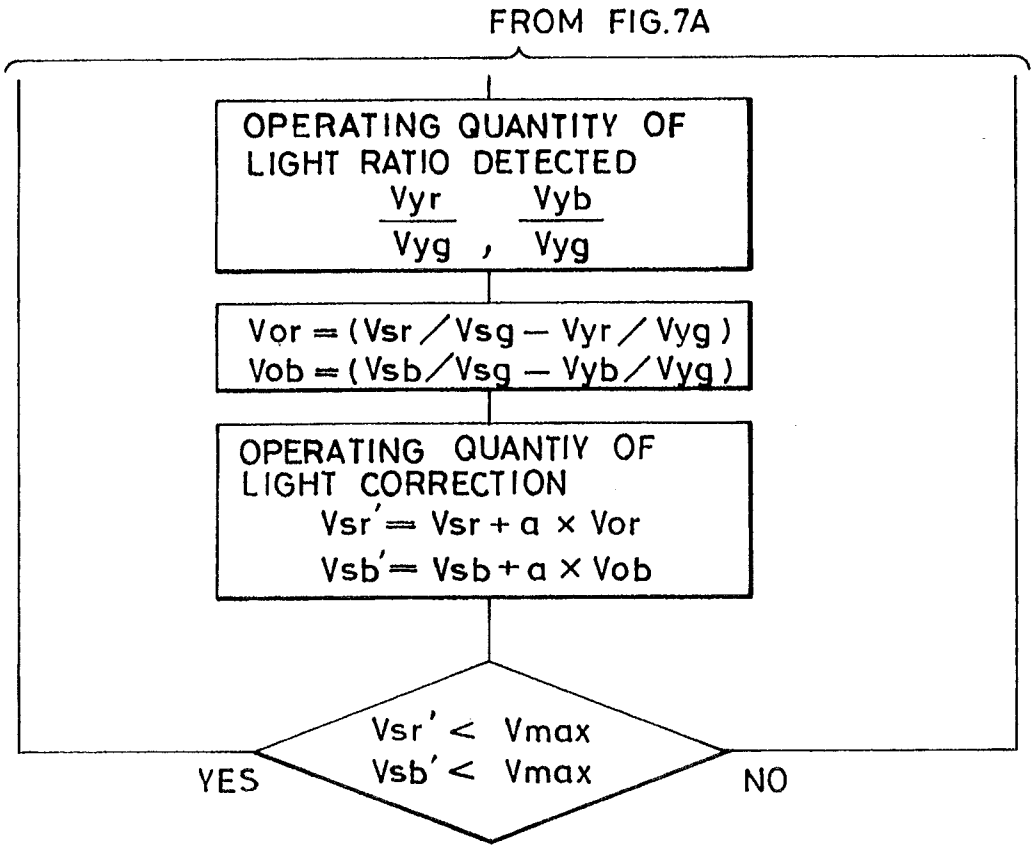

In FIG. 7, there is shown another embodiment utilizing the arrangement of FIG. 5, in which, when the correction has reached an extent exceeding the upper dimming limit of the light source of the emission color R or B, the correction for lowering the dimming quantity of the light source of the emission color G is performed, whereby the correction is so made that the dimming ratio for the light sources of the emission colors of R and B will not exceed the upper limit, and the blended color light can be obtained at a high precision. In the dimming level discriminator 28, the upper quantity-of-light limit $V_{max}$ corresponding to the upper limit dimming level of the dimmer is preliminarily stored. The corrected quantity-of-light data $V_{sr}'$ and $V_{sb}'$ are compared with this $V_{max}$ so that, when $V_{sr}'\leqq V_{max}$ and $V_{sb}'\leqq V_{max}$, the correction of the luminaire light color is performed by means of the quantity-of-light correction of R and B in accordance with these corrected quantity-of-light data. When $V_{sr}'>V_{max}$ or $V_{sb}'>V_{max}$, then the quantity-of-light correction of G is carried out. The corrected quantity-of-light data $V_{sg}'$ for G is made to be $$V_{sg}'=V_{sg}-\Delta V_{sg}$$

Thus, $\Delta V_{sg}$ is deducted from the quantity-of-light data $V_{sg}$, and the dimming signal is so modified as to reduce the quantity-of-light of G. This reduction of light for G is continued until $V_{sr}'<V_{max}$ and $V_{sb}'<V_{max}$. Through such correction of the quantity-of-light for R, G and B, it is made possible to obtain the luminaire light involving no color deviation with respect to the predetermined emission color.

Figure 8A:
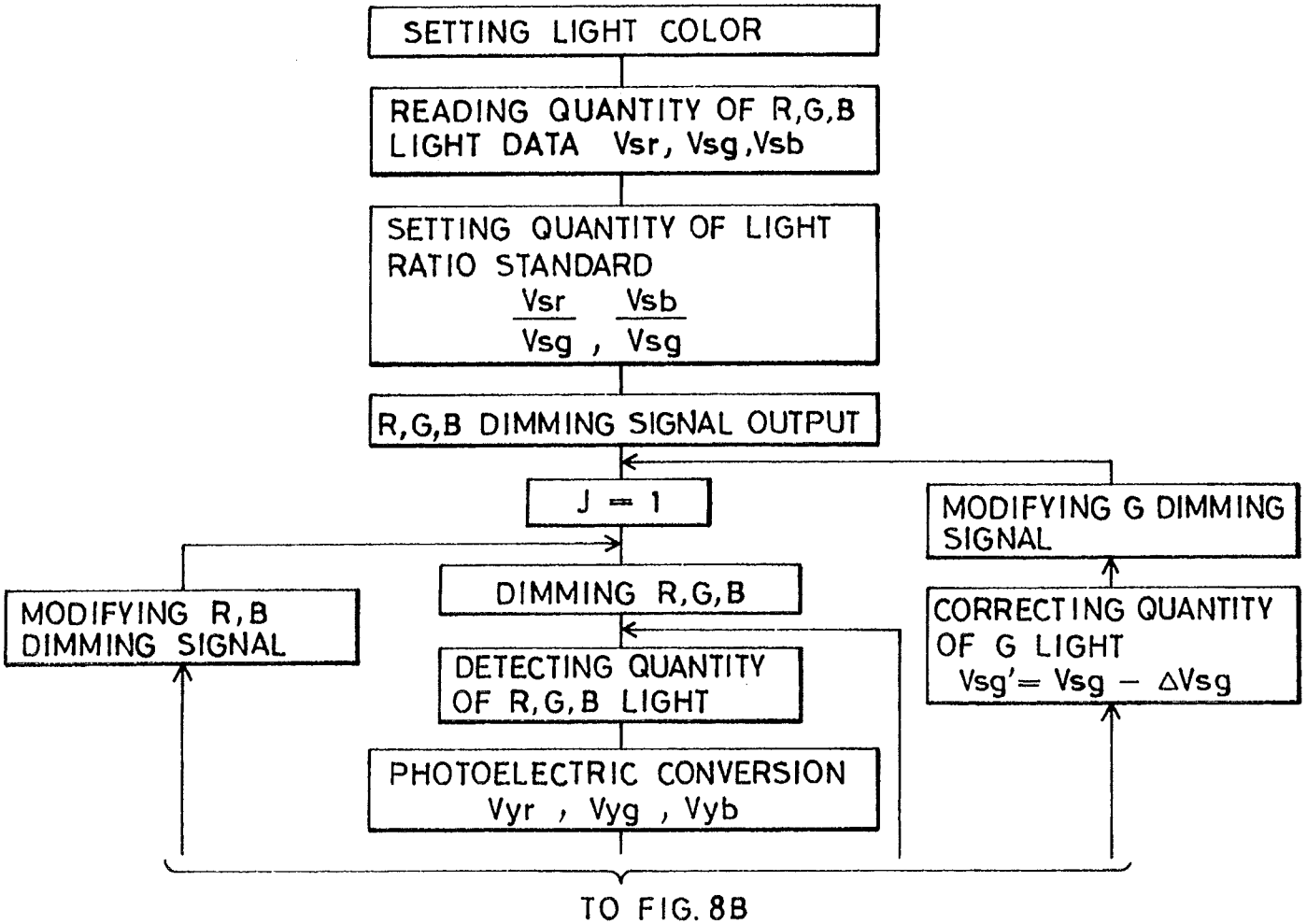
FIG. 8 consisting of the combination of FIGS. 8A and 8B is a flow-chart of the operation in still another embodiment in which the luminaire of FIG. 1 is utilized.
Figures 8, 8B:
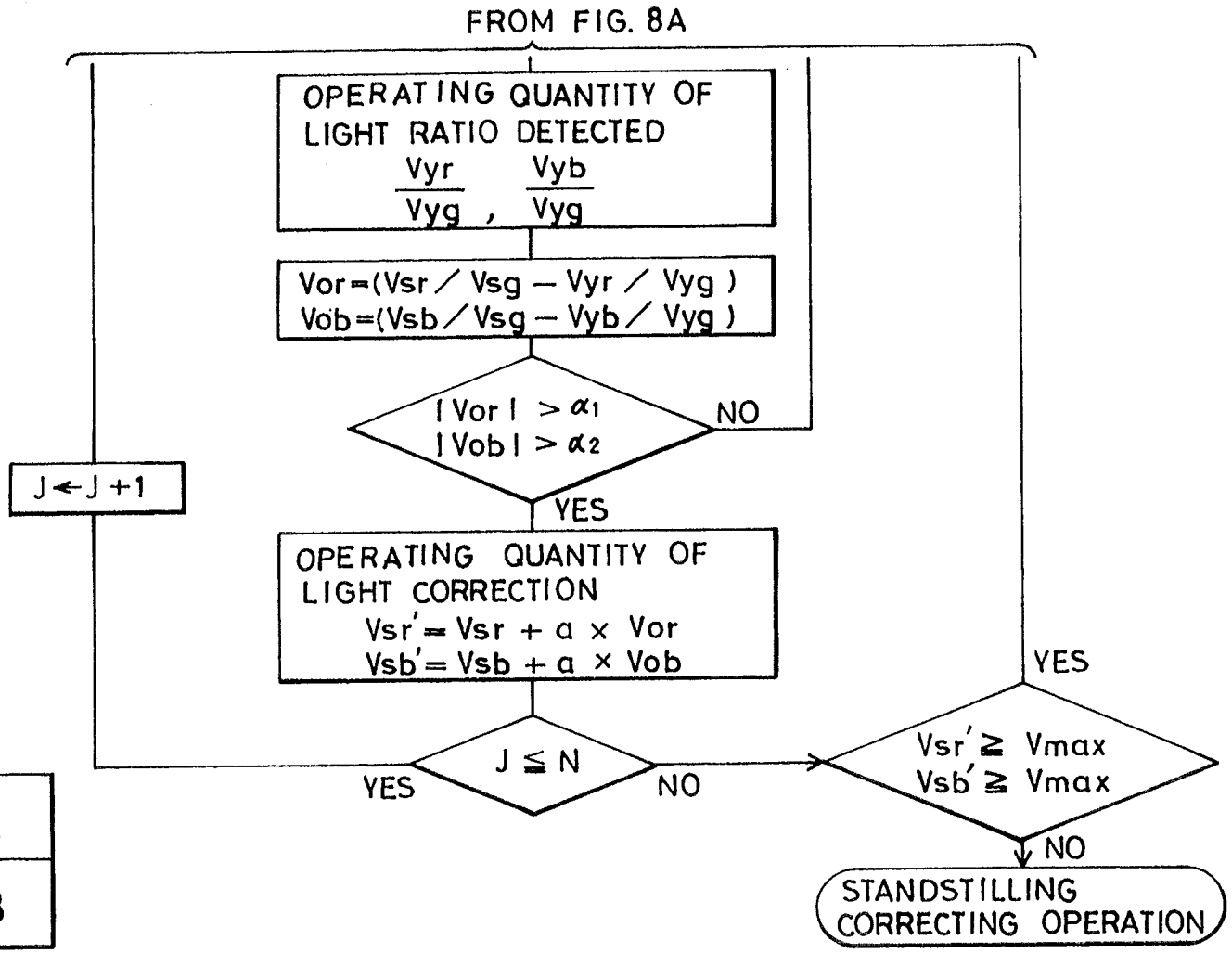

In a further embodiment shown in FIG. 8 utilizing the arrangement of FIG. 1, the dimming level is discriminated after the convergence discrimination, upon which it is assumed that the upper dimming limit of the light sources 12R and 12B for the emission colors R and B is $V_{max}$, the corrected quantity-of-light data $V_{sr}'$ and $V_{sb}'$ are compared with the upper dimming limit $V_{max}$ so that, when either one of the data is above the upper dimming limit $V_{max}$, the quantity-of-light correction ($V_{sg}'=V_{sg}-\Delta V_{sg}$) for reducing the quantity-of-light of the light source 12G for G is carried out to modify the dimming signal for the light source 12G, and the operation of R, G and B is again carried out.

Figure 9A:
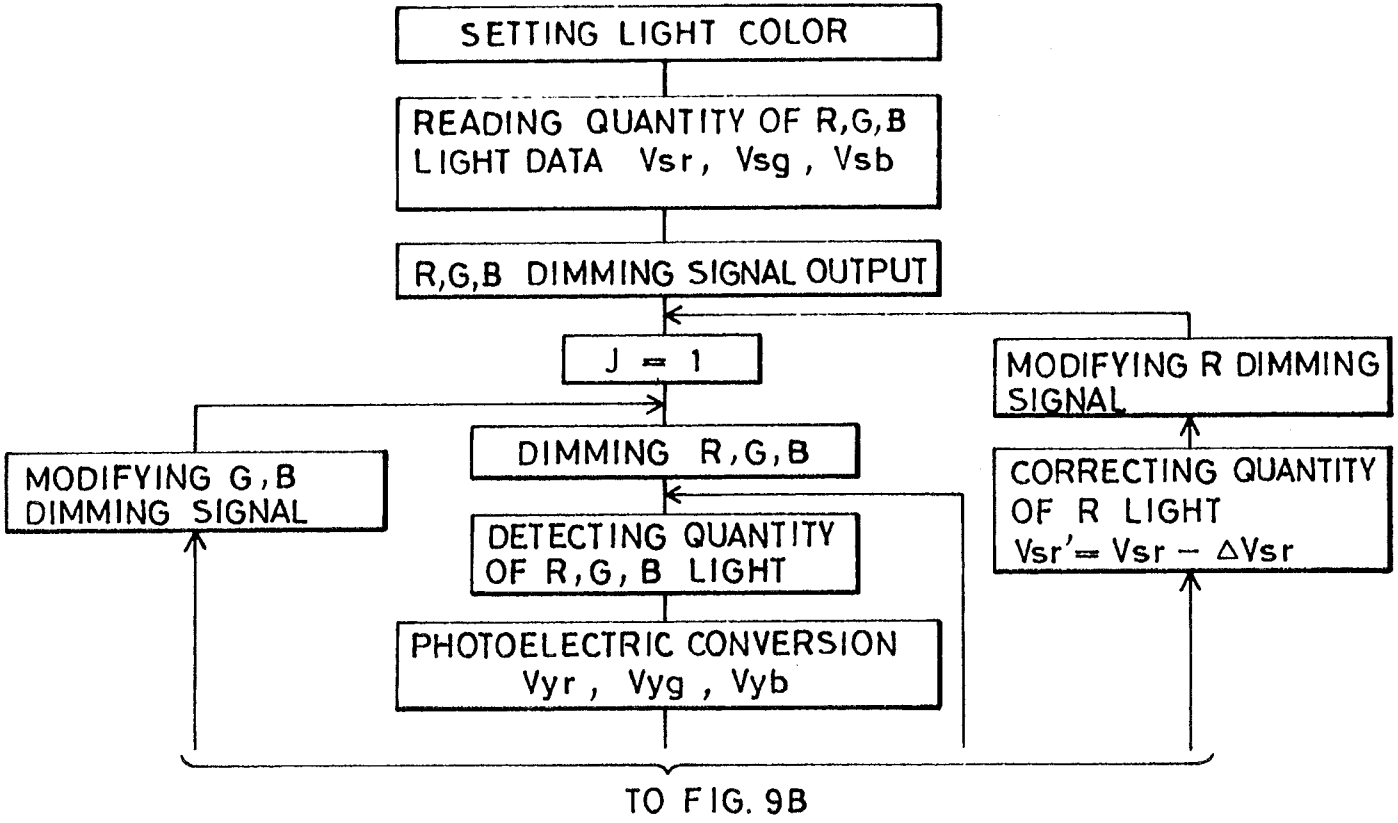
FIG. 9 consisting of the combination of FIGS. 9A and 9B is a flow-chart of the operation in still another embodiment in which the luminaire of FIG. 3 is utilized.
Figures 9, 9B:
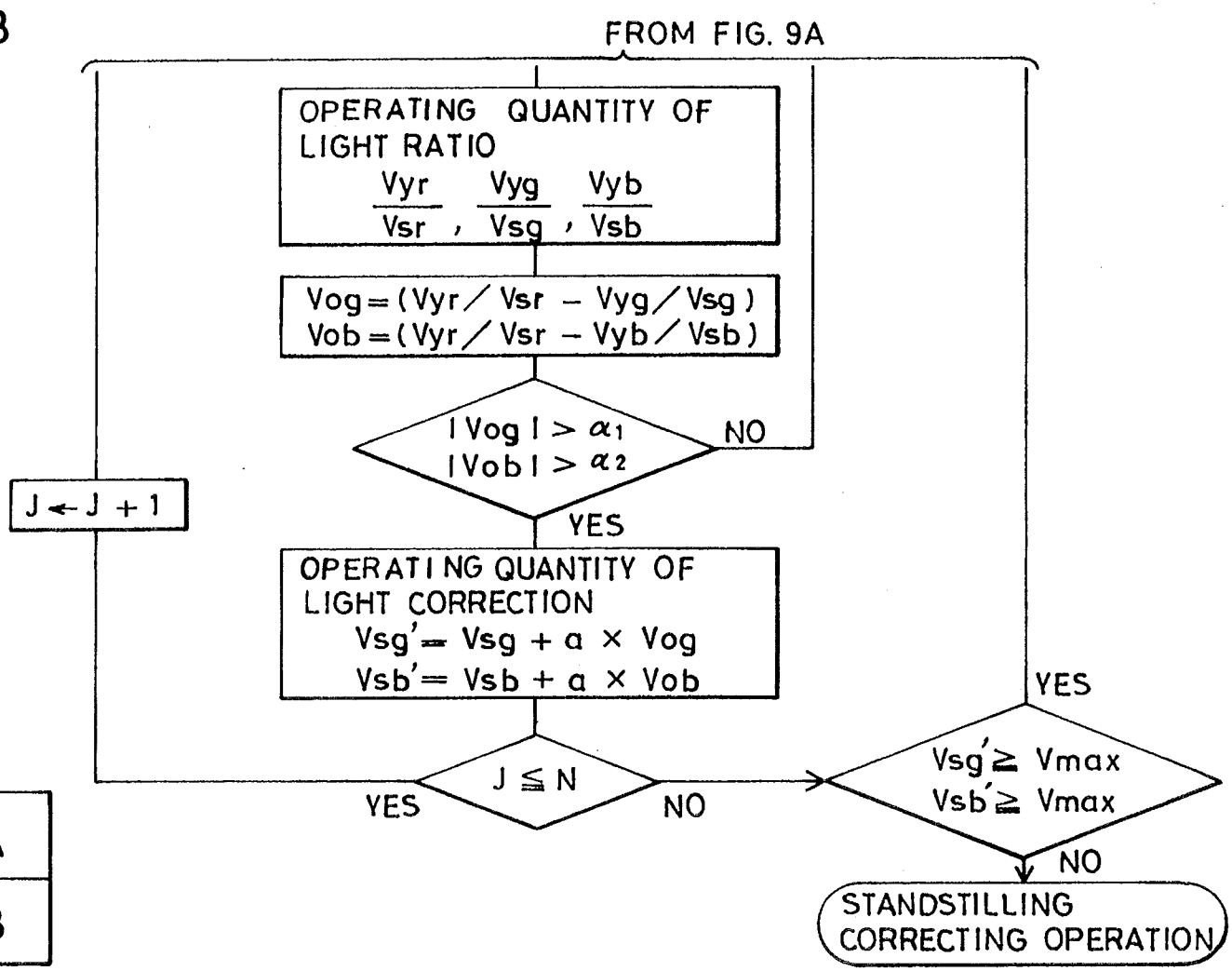

In FIG. 9, another embodiment employing the arrangement of FIG. 3 is shown, in which, instead of the lower dimming limit $V_{min}$, the arrangement is made to discriminate the upper dimming limit $V_{max}$. Other operation in this case is the same as that in the foregoing embodiment of FIG. 3.

Figure 10A:
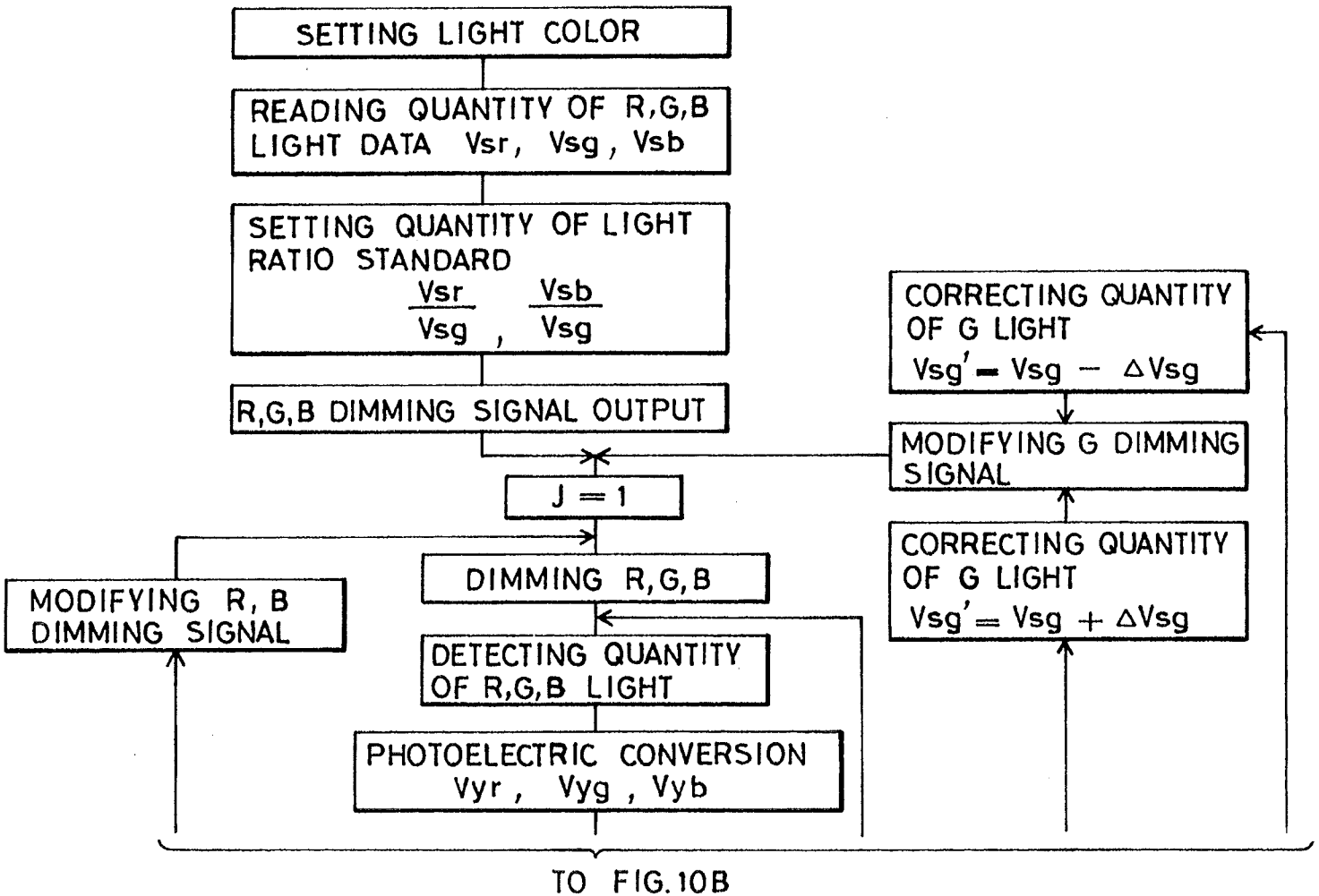
FIG. 10 consisting of the combination of FIGS. 10A and 10B is a flow-chart showing the operation of another embodiment utilizing the luminaire of FIG. 1.
Figures 10, 10B:
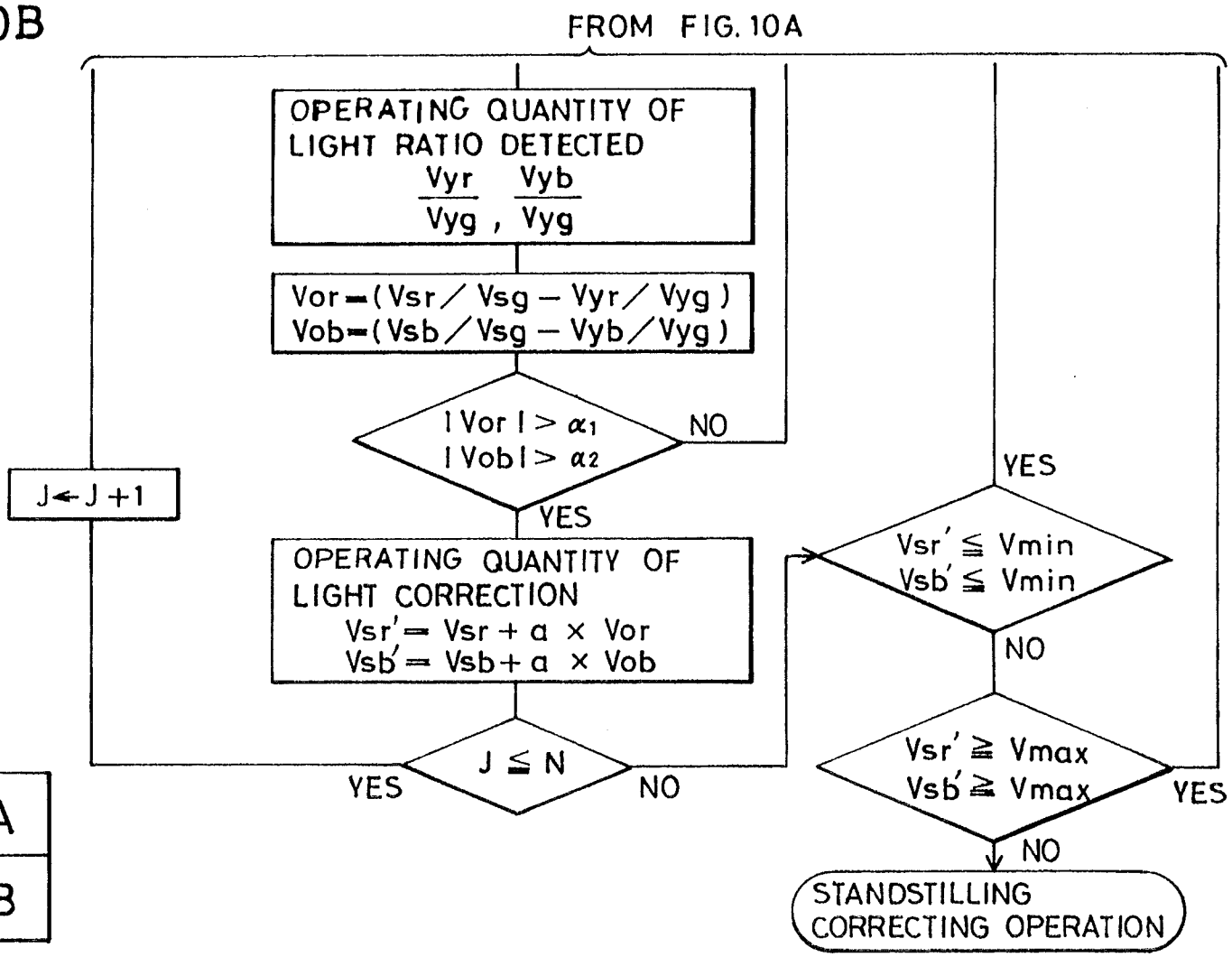

In FIG. 10, a further embodiment employing the arrangement of FIG. 1 is shown, in which the arrangement is different from that of FIG. 1 only in respect that the discrimination of the lower dimming limit $V_{min}$ and the discrimination of the upper dimming limit $V_{max}$ as has been described with reference to FIG. 5 are concurrently performed, and other operation is the same as that in the embodiment of FIG. 1.

Now, as has been described with reference to the embodiments of FIGS. 7–10, the quantity-of-light of the respective light sources 12R, 12G and 12B is detected to operate the ratio of the detected quantity-of-light of other two light sources with respect to that of one light source, and the comparison operation of such detected quantity-of-light ratio with respect to the reference quantity-of-light ratio is carried out, and the dimming quantity for the respective light sources can be smoothly corrected.

In carrying out the correction of the luminaire light color so that, in an event where the corrected dimming quantity of either one of the light sources exceeds the upper dimming limit, any deviation from the set emission color will be prevented by reducing the quantity-of-light of one of other light sources, a following technical matter should optimumly be taken into account.

Provided here that the light sources 12R, 12G and 12B of red colors R, green colors G and blue colors B are employed and the chromaticity coordinate of the emission color of the respective light sources and the illuminance of the respective light sources on the reference irradiation surface are set to be 270 [1x], then the dimming levels of the respective light sources 12R, 12G and 12B with respect to the color temperatures of the luminaire light will be as in a following TABLE II:

TABLE II

| | Clr. Temp. [K] | Chrmt-cty. x | Coord. y | Dim.Lvl.of Lght.Surc.[%] 12R | 12G | 12B |
|---|---|---|---|---|---|---|
| Daylight Color: | 6,250 | 0.314 | 0.345 | 39 | 93 | 74 |
| White Color: | 4,200 | 0.378 | 0.388 | 65 | 95 | 36 |
| Warm White Clr.: | 3,450 | 0.409 | 0.394 | 90 | 78 | 26 |
| Elc. Lmp.Clr.(I): | 3,450 | 0.409 | 0.394 | 90 | 78 | 26 |
| Elc. Lmp.Clr.(II): | 2,950 | 0.440 | 0.403 | 97 | 73 | 15 |

In the case when the setting is made at, for example, 2,950 [K] of the electric lamp color, and so long as the maximum illuminance of the respective light sources will be the foregoing values 110 [1x], 220 [1x] and 30 [1x], then the color temperature can be established with the dimming levels of 97% for the light source 12R, 73% for 12G and 15% for 12B as seen in TABLE II. Provided here that the quantity-of-light of only 70% could be obtained for the light source 12R due to a reduction in the luminous flux or the like, the comparison operation output $V_{or}$ becomes larger so that, due to $V_{sr}'=V_{sr}+a\times V_{or}$, it is made necessary that $V_{sr}'$ is subjected to a considerable extent of the quantity-of-light correction with respect to $V_{sr}$. On the other hand, the dimming level of the light source 12R at this moment is 97%, which is close to the upper dimming limit and does not allow an increase in the quantity-of-light for more than 3%, and the set color temperature has not been reached while the upper dimming limit level $V_{max}$ has been reached. For this reason, it is required to execute the quantity-of-light correction of the light source 12G of green colors G, and the correction is continued until the value of $V_{or}$ becomes smaller while reducing the quantity-of-light of G. That is, in order to obtain the set color temperature, it is necessary that the quantity-of-light of the green colors G and blue colors B are varied for about 30% from the ideal state dimming levels of 73% and 15%, so that the whole quantity-of-light will be about 70% of the ideal state of 270 [1x], i.e., about 189 [1x]. In other words, it is required to take into account that, in respect of a color temperature which renders the dimming level of either the red colors R or blue colors B to be closer to the upper dimming limit, the quantity-of-light is lowered in order to be closer to the predetermined value in an event where a remarkable lowering has taken place in the output of corresponding light source, and eventually the brightness which is the basic function of the luminaire is likely to be unable to be sufficiently increased.

Figure 11A:
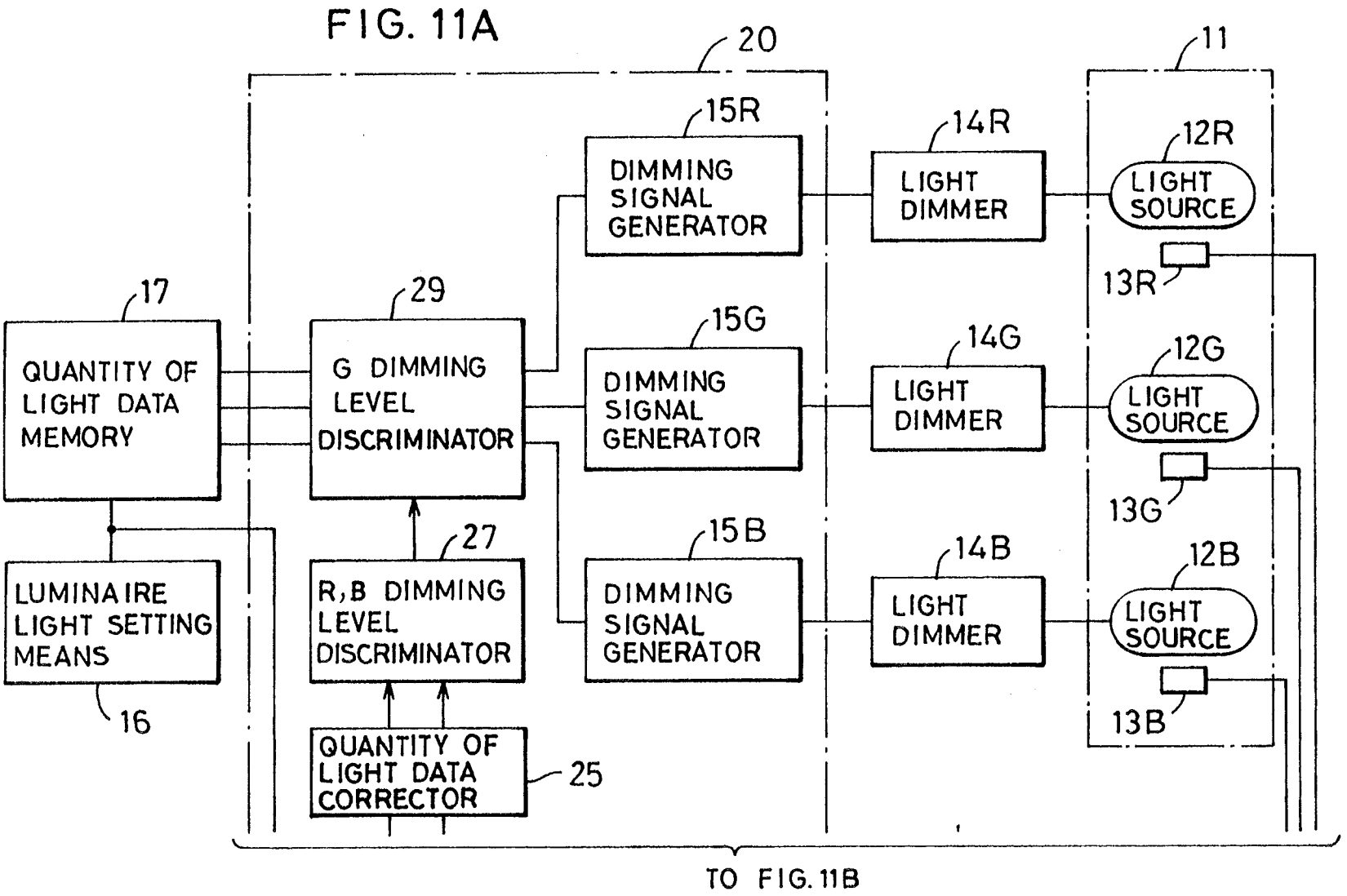
FIG. 11 consisting of the combination of FIGS. 11A and 11B shows in a block diagram a further embodiment of the luminaire according to the present invention.
Figures 11, 11B:
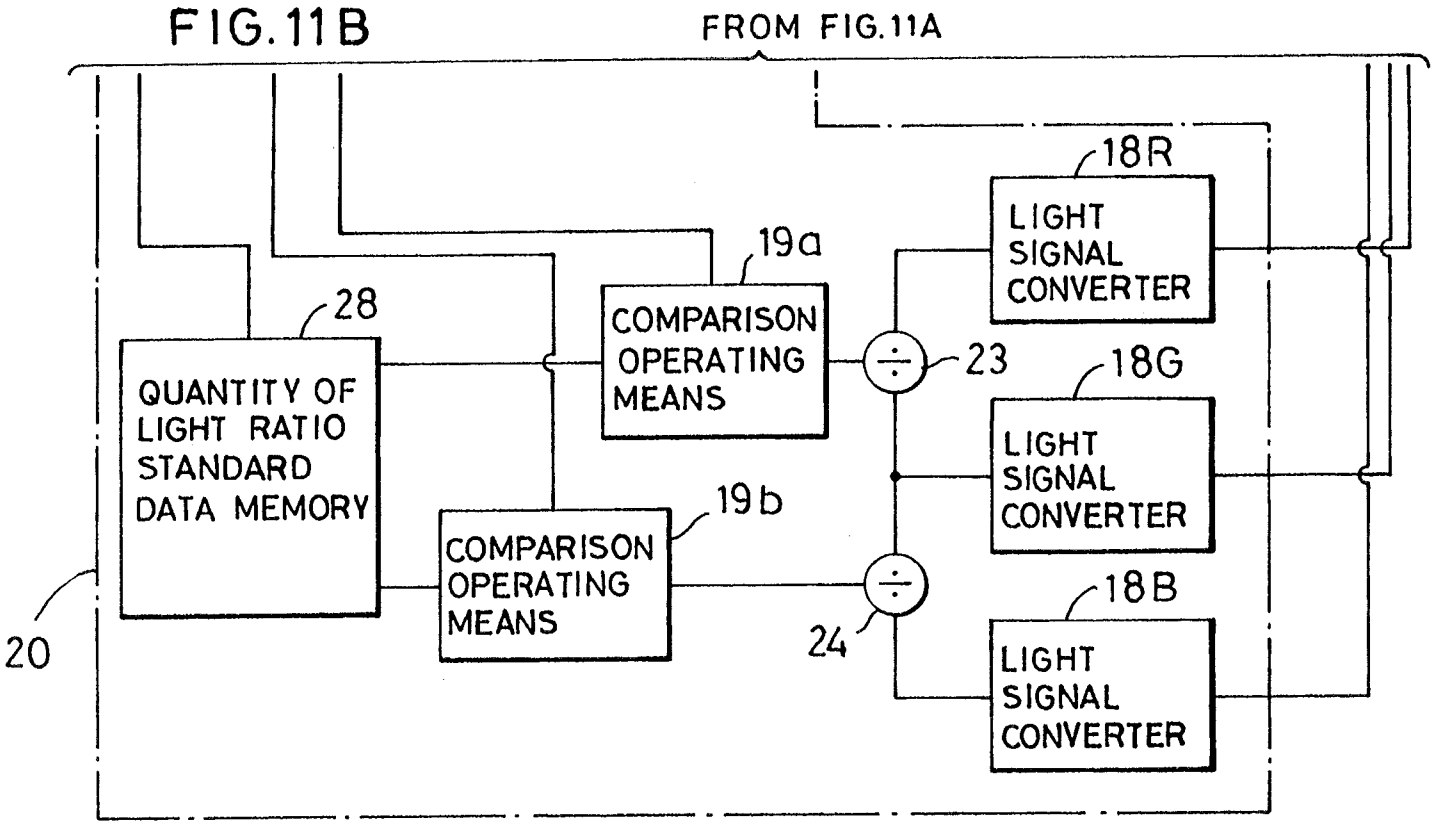
Figure 12A:
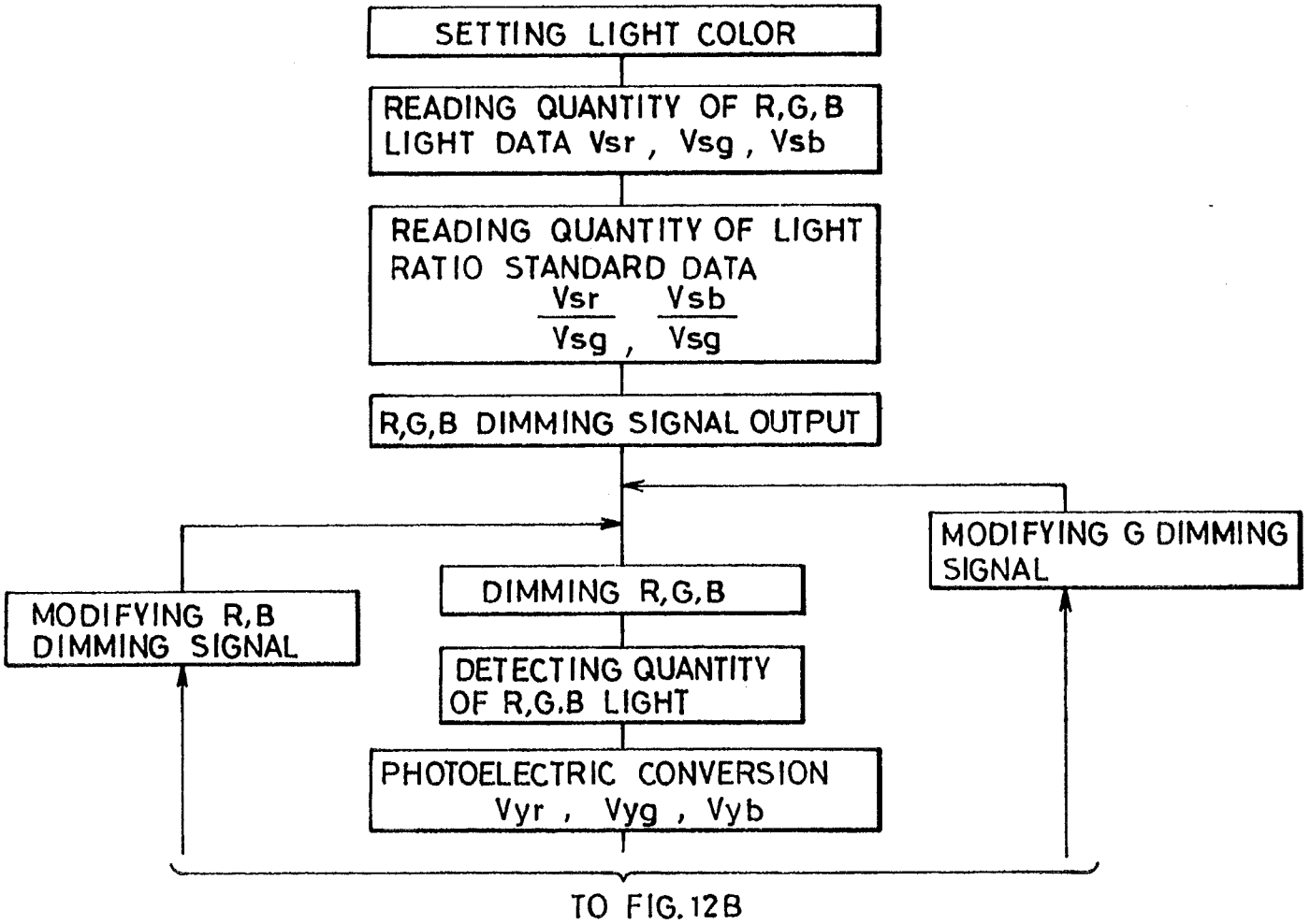
FIG. 12 consisting of the combination of FIGS. 12A and 12B is a flow-chart of the operation of the embodiment of FIG. 11.
Figures 12, 12B:
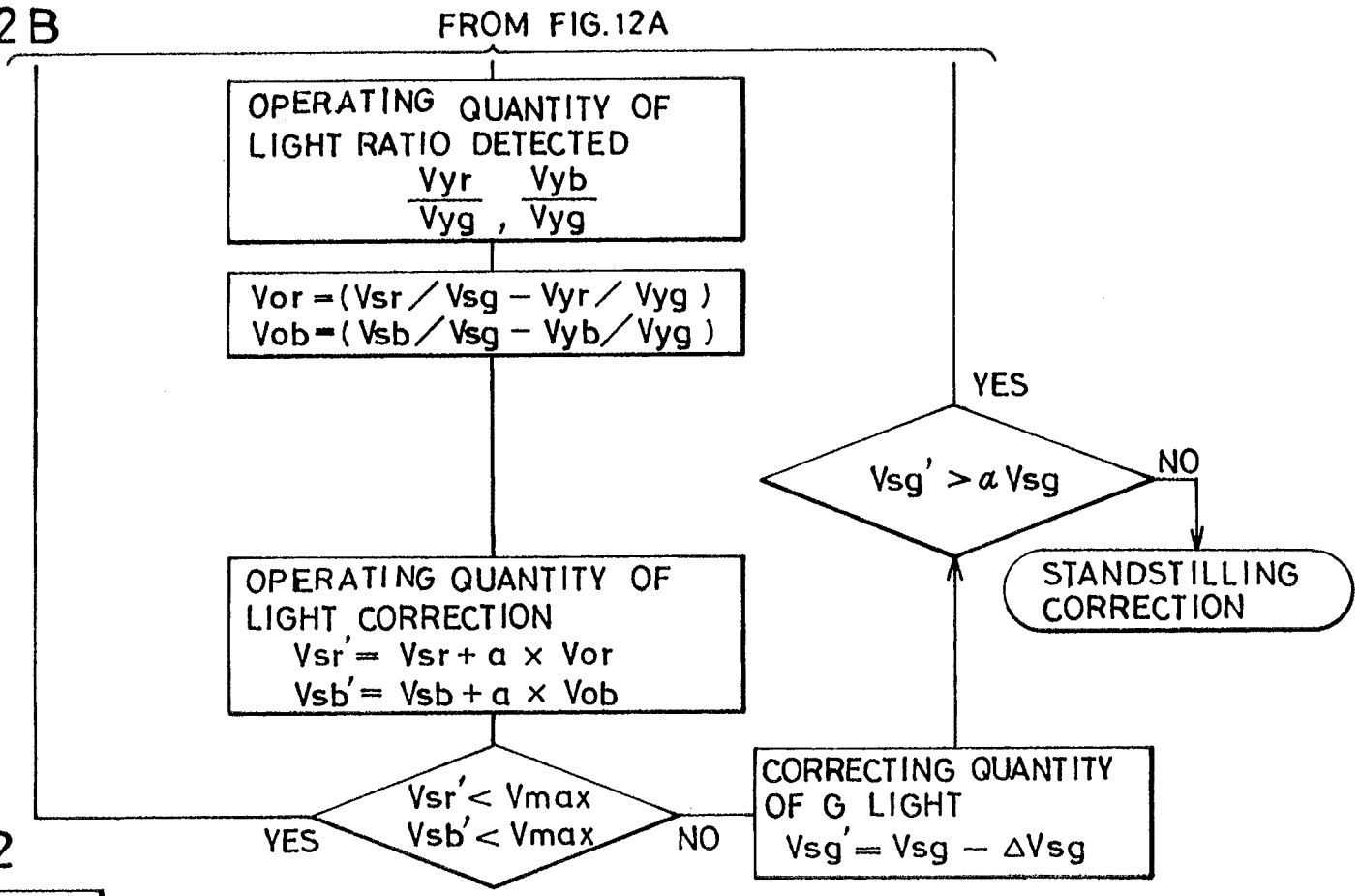

Referring next to FIG. 11, there is shown still another embodiment of the present invention capable of preventing further excellently any deviation of the luminaire light color from the set blended color, and FIG. 12 shows a flow-chart of the operation of this embodiment. While very similar arrangement to the embodiment of FIG. 5 is adopted in the present embodiment, the arrangement is different in that its dimming level discriminating means comprises the dimming level discriminator 28 for R and B and additionally a dimming level discriminator 29 for G. In this case, the corrected quantity-of-light data $V_{sr}'$ and $V_{sb}'$ obtained at the quantity-of-light data corrector 25 are input into the R, B dimming level discriminator 28 which preliminarily stores the upper dimming limit $V_{max}$ corresponding to the upper level of the dimmers 14R and 14B. The corrected quantity-of-light data $V_{sr}'$ and $V_{sb}'$ are compared with the upper dimming limit $V_{max}$ so that, when $V_{sr}'\leqq V_{max}$ and $V_{sb}'\leqq V_{max}$, the luminaire light color is corrected by means of the quantity-of-light correction for R and B in accordance with the corrected quantity-of-light data $V_{sr}'$ and $V_{sb}'$. When the R, B dimming level discriminator 28 discriminates $V_{sr}'<V_{max}$ or $V_{sb}'<V_{max}$, the quantity-of-light correction for G is carried out. The corrected quantity-of-light data $V_{sg}'$ for G is made to be $$V_{sg}'=V_{sg}-\Delta V_{sg}$$

Thus, $\Delta V_{sg}$ is deducted from the quantity-of-light data $V_{sg}$ for G, and the dimming signal is modified for reducing the quantity-of-light of G. When the corrected quantity-of-light data $V_{sg}'$ is within a certain ratio (if made to be $\alpha$, a constant between $0<\alpha<1$) with respect to the quantity-of-light signal $V_{sg}$ set for G, the dimming level for the respective light source is controlled so as to be reduced in the light to attain a predetermined color temperature. When the quantity-of-light level of G becomes below a certain ratio, i.e., $V_{sg}'\leqq\alpha V_{sg}$, current state of the quantity-of-light of G is maintained without its reduction, and the present operation for the correction is stopped, whereby, in an event where the quantity-of-light of any one of the light-sources which is close to the upper dimming limit and is remarkably reduced, the quantity-of-light of other light sources is remarkably reduced, so as to prevent the whole quantity-of-light from being remarkably reduced. In other words, the prevention of lowering in the quantity-of-light to a remarkable extent is given the priority and the brightness as being the basic function of the luminaire is maintained.

Figure 13A:
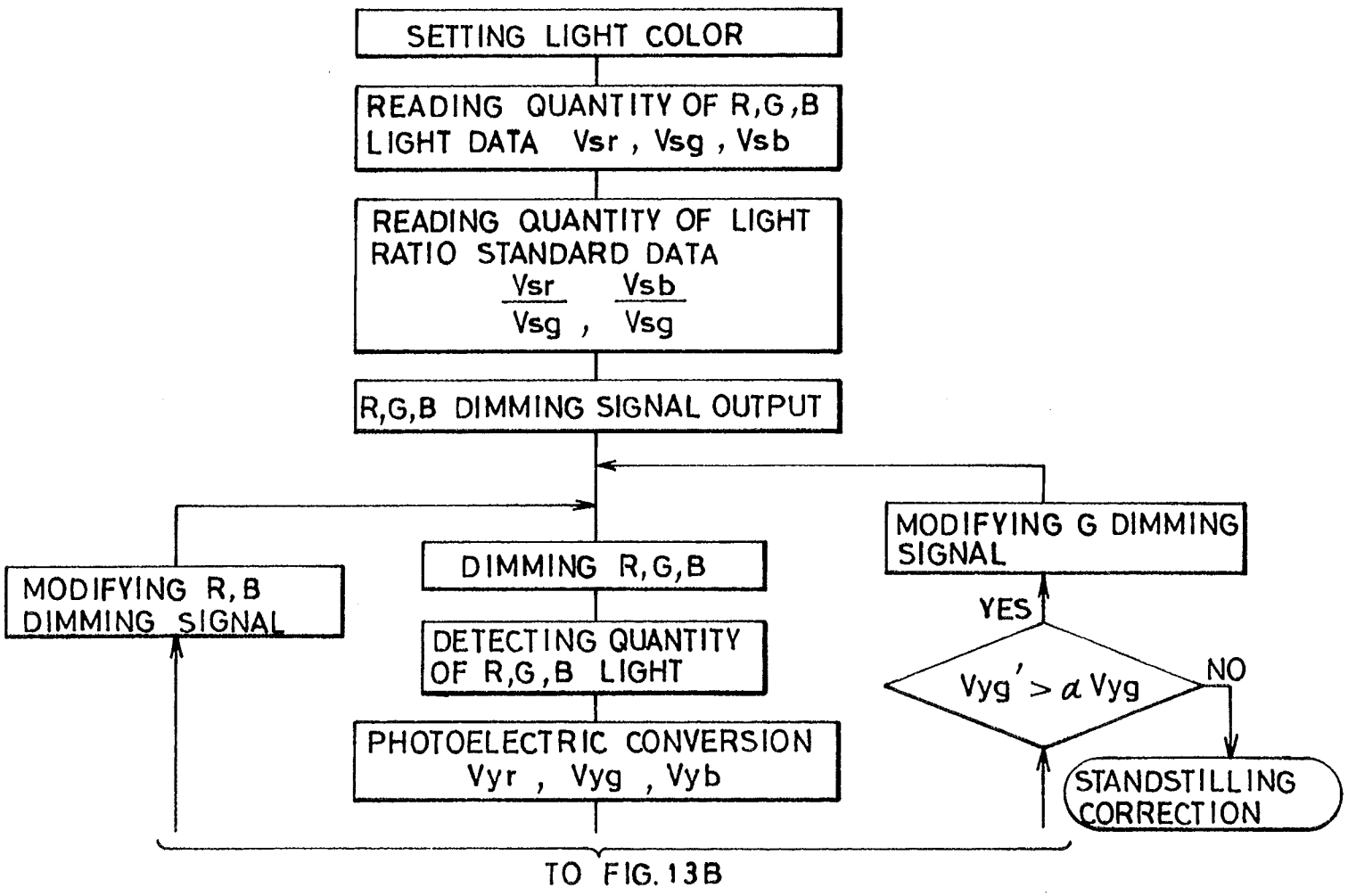
FIG. 13 consisting of the combination of FIGS. 13A and 13B is a flow-chart of another embodiment utilizing the luminaire of FIG. 11.
Figures 13, 13B:
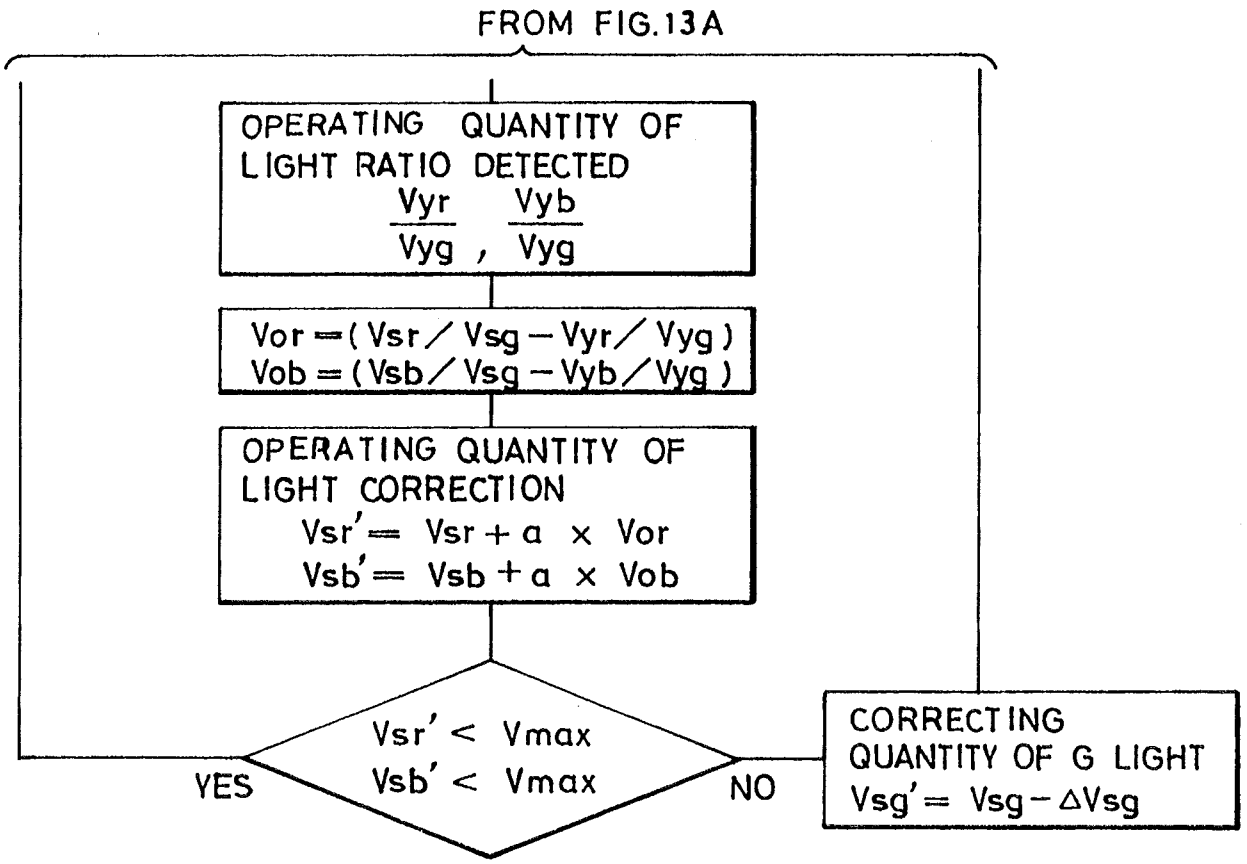

In FIG. 13, there is shown another embodiment in which the arrangement of FIG. 11 is utilized. While in the embodiment of FIG. 11 the discrimination of the quantity-of-light level for G is made by means of the value of the quantity-of-light data $V_{sg}$, the light output level $V_{yg}$ of the light source 12G for G is made not to be reduced in the quantity-of-light when the output has become below a certain value, that is, $V_{yg} \leqq \alpha V_{yg}$ $(0<\alpha<1)$ but is retained at a state of the quantity-of-light at that moment, and the correction is stopped.

Figure 14A:
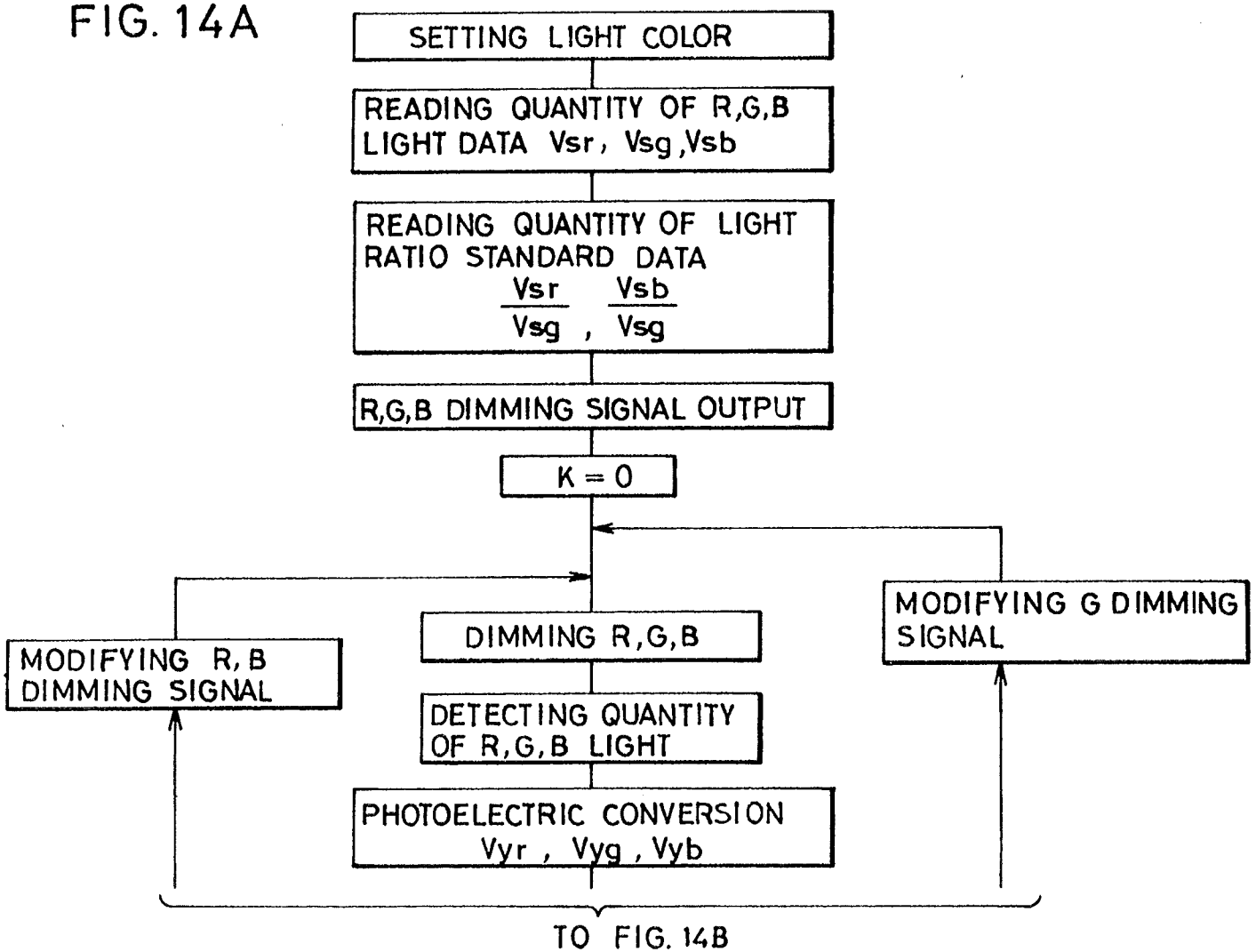
FIG. 14 consisting of the combination of FIGS. 14A and 14B is a flow-chart of another embodiment of the present invention employing the luminaire of FIG. 11.
Figures 14, 14B:
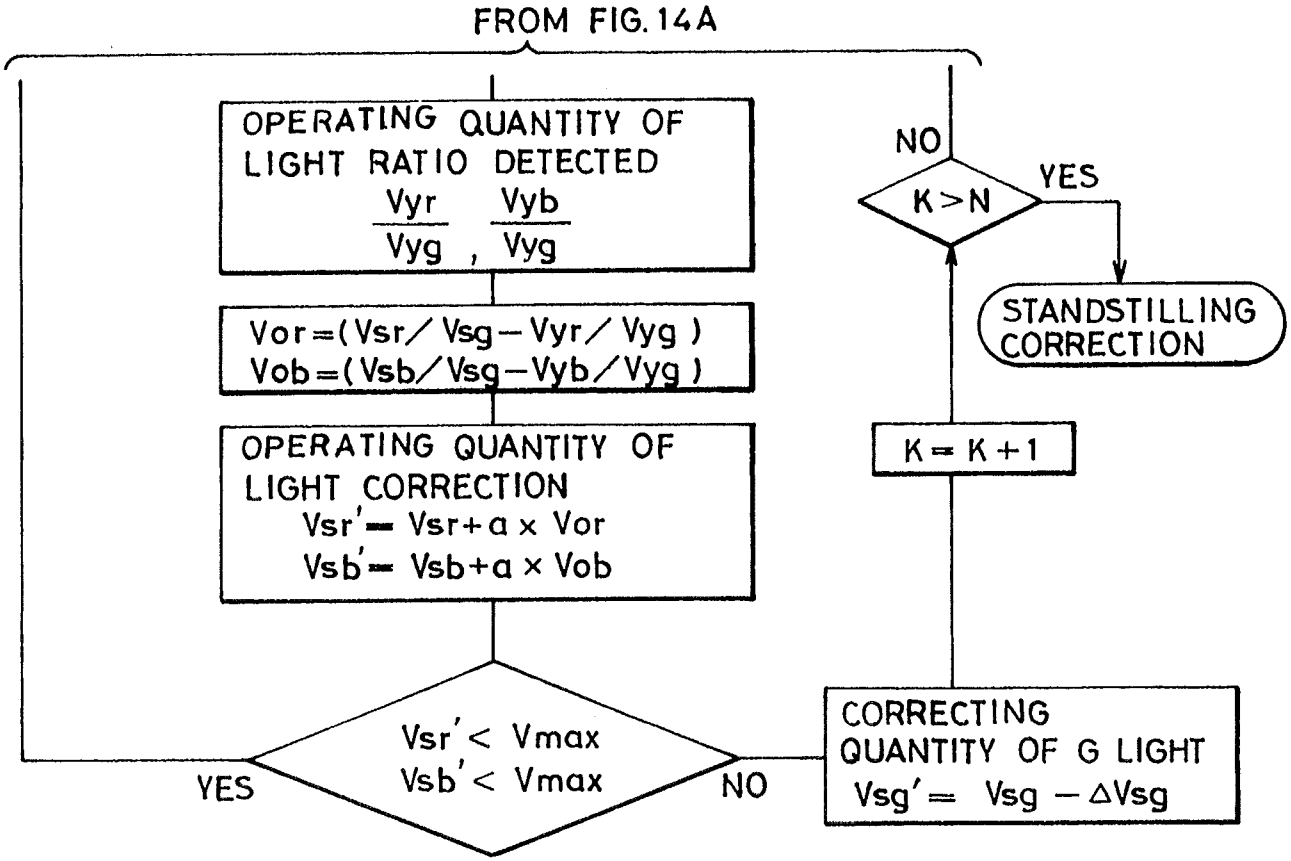

Also in FIG. 14, there is shown another embodiment in which the arrangement of FIG. 11 is employed. While in the embodiment of FIG. 11 the quantity-of-light of G is discriminated by the value of the quantity-of-light data $V_{sg}$, the present embodiment employs the correction frequency of the quantity-of-light for G as a parameter k, the quantity-of-light for G is no more reduced when the frequency k is larger than a value N, the state of the quantity-of-light at that moment is maintained, and the correction is ceased, upon which the quantity-of-light data of G will be reduced to $$V_{sg}' = V_{sg} - \Delta V_{sg} \times N$$

Here, ΔV and N may be set in conformity to the quantity-of-light discrimination level for G.

Further, the foregoing extent of the convergence discrimination should preferably be so determined to be made larger as the level difference of light due to the light reduction caused at the light source as the result of the quantity-of-light correction becomes larger, or to be kept not varied until a predetermined value is reached by the light reduction level but to be enlarged as the level exceeds the predetermined value.

Figure 15A:
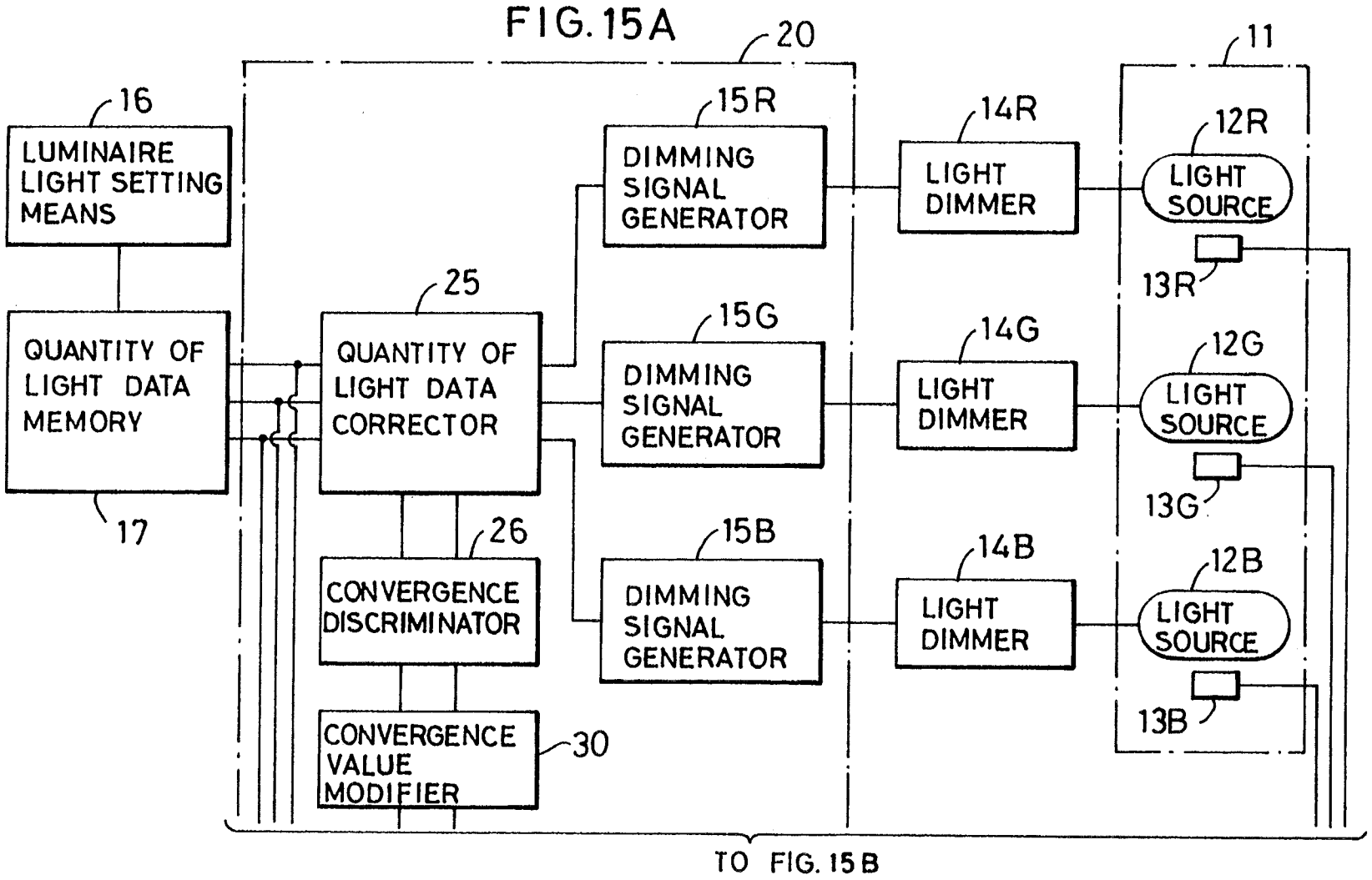
FIG. 15 consisting of the combination of FIGS. 15A and 15B is a block diagram showing still another embodiment of the present invention.
Figures 15, 15B:
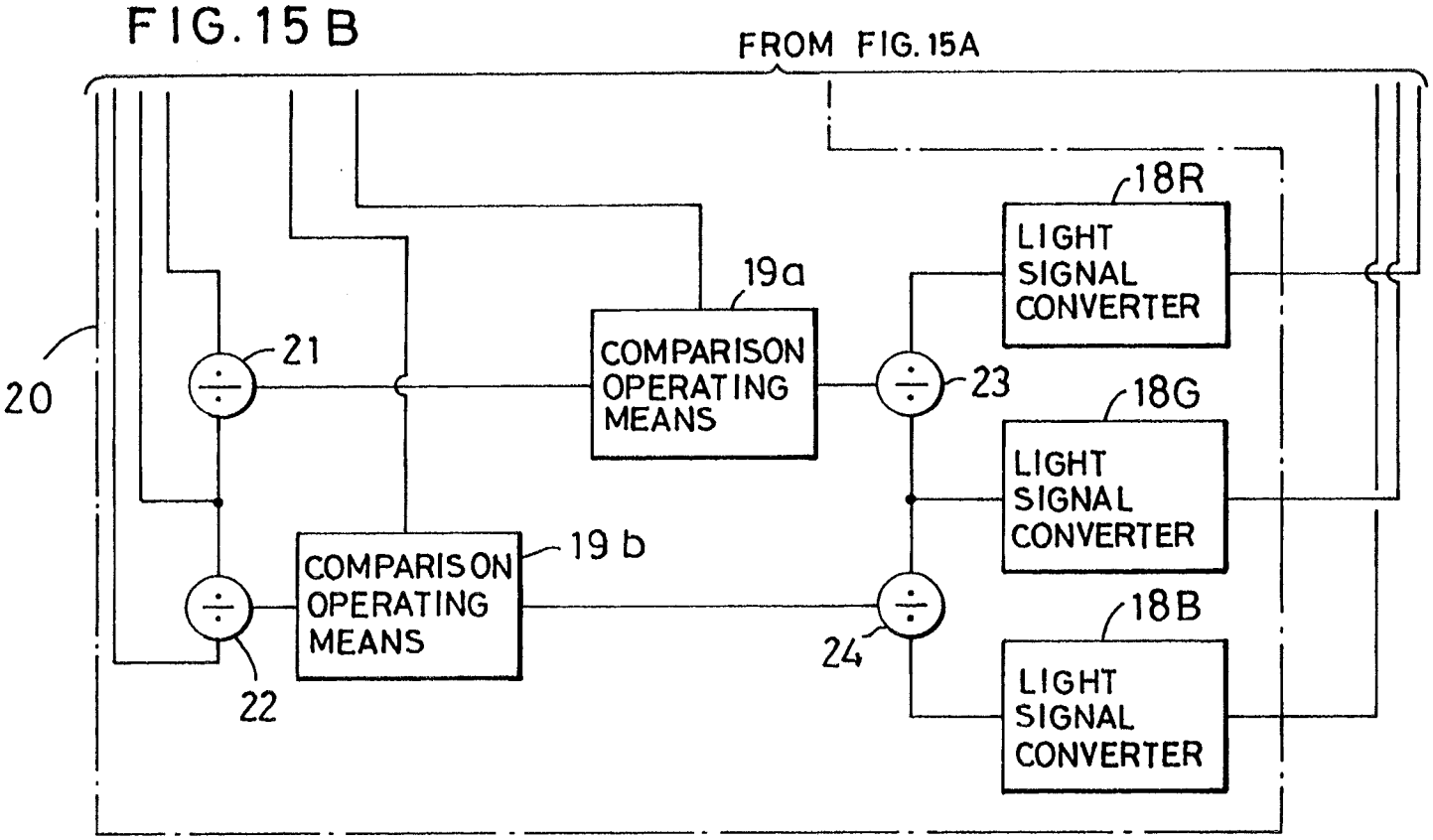
Figure 16A:
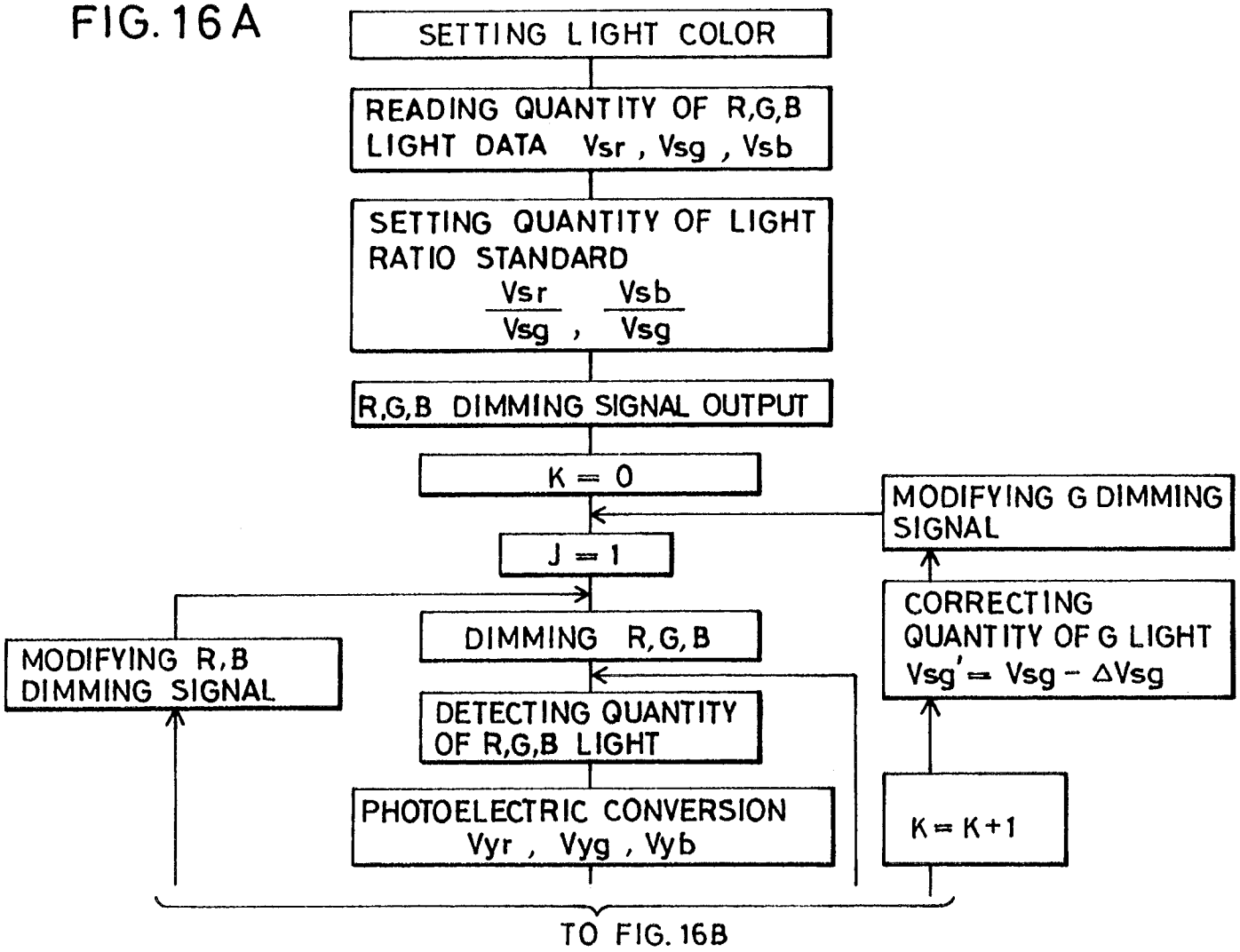
FIG. 16 consisting of the combination of FIGS. 16A and 16B shows in a flow-chart of the operation of the embodiment of FIG. 15.
Figures 16, 16B:
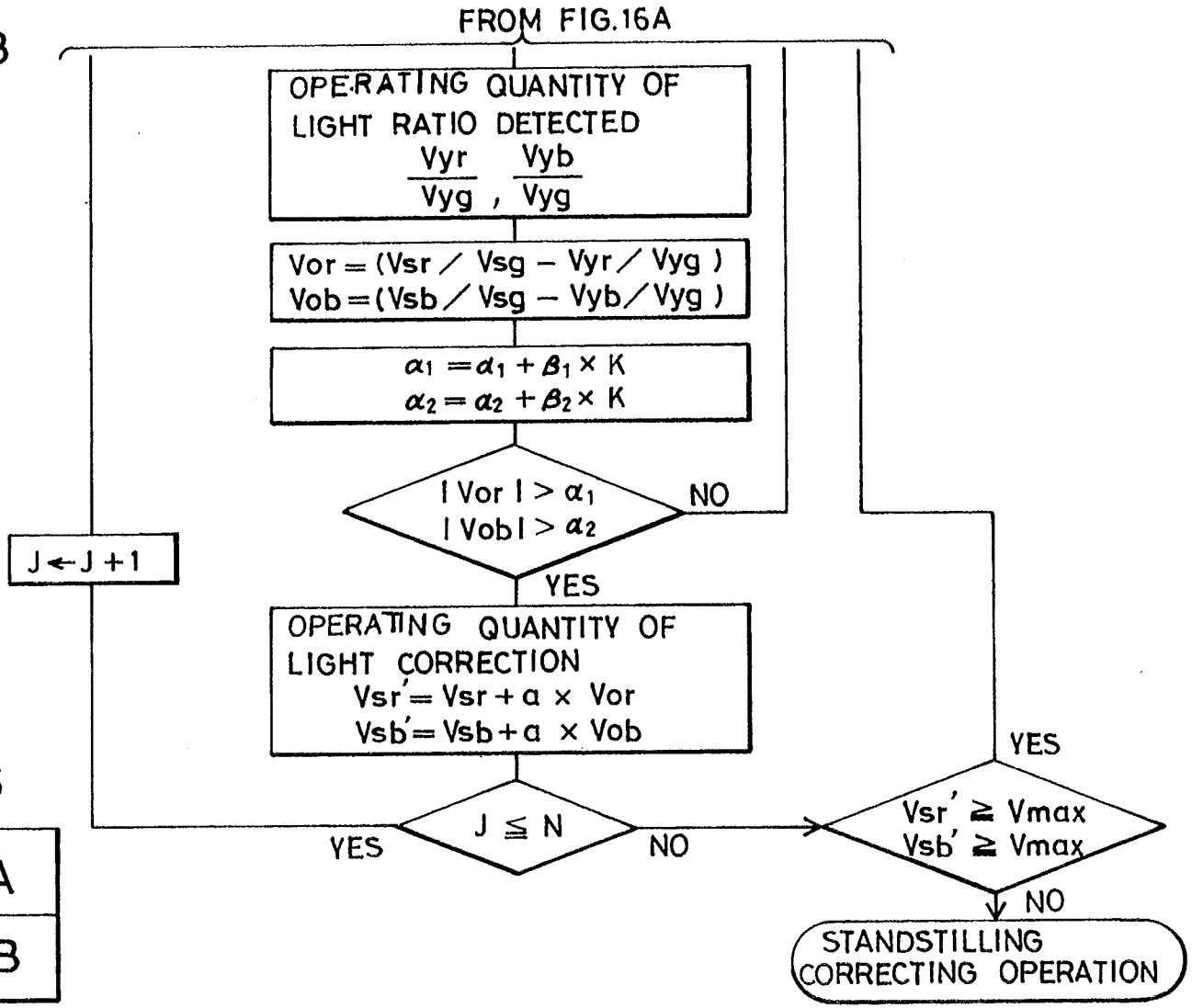

Referring here to FIG. 15, there is shown another embodiment of an arrangement similar to that of FIG. 1, the operation of which is shown by a flow-chart of FIG. 16. In the present instance, a convergence value modifier 30 is additionally provided to the convergence discriminator 26 in contrast to the embodiment of FIG. 1. In this case, as the quantity-of-light correction for G initially takes place so that $V_{sg}' = V_{sg} - \Delta V_{sg}$, then $K=K+1$ will be $K=1$, and the light source for G is subjected to the light reduction by a new dimming signal for G, subsequent to which the operation of the detection quantity-of-light ratio is carried out for R and B similarly to the embodiment of FIG. 1 so as to compute $$V_{or} = (V_{sr}/V_{sg} - V_{yr}/V_{yg})$$

$$V_{ob} = (V_{sb}/V_{sg} - V_{yb}/V_{yg})$$

At this time, the convergence values $\alpha 1$ and $\alpha 2$ will be, with $K=1$, $$\alpha 1 = \alpha 1 + \beta 1, \text{ and } \alpha 2 = \alpha 2 + \beta 2$$

so that they will be made larger, through the convergence value modifier 30, than the values $\alpha 1$ and $\alpha 2$ prior to the light reduction of the quantity-of-light for G respectively by an amount of $\beta 1$ and $\beta 2$. That is, the tolerance of convergence is enlarged so that the convergence can easily take place, whereby the convergence values are enlarged in the width every time when the correction is repeated even when the convergence does not take place at the first time correction of the quantity-of-light reduction for G and required frequancy for reaching the convergence can be reduced, that is, the extent of reduction in the quantity-of-light for G can be made smaller. It is made possible thereby to prevent from occurring that, in an event where the quantity-of-light of one or more of the light sources close to the upper dimming limit is reduced to a large extent, the whole quantity-of-light will be caused to be reduced remarkably due to that the quantity-of-light of remaining light source is also reduced to a large extent. In other words, it is made possible to give priority to the prevention of reduction in the quantity-of-light, rather than the retention of emission color.

Figure 17A:
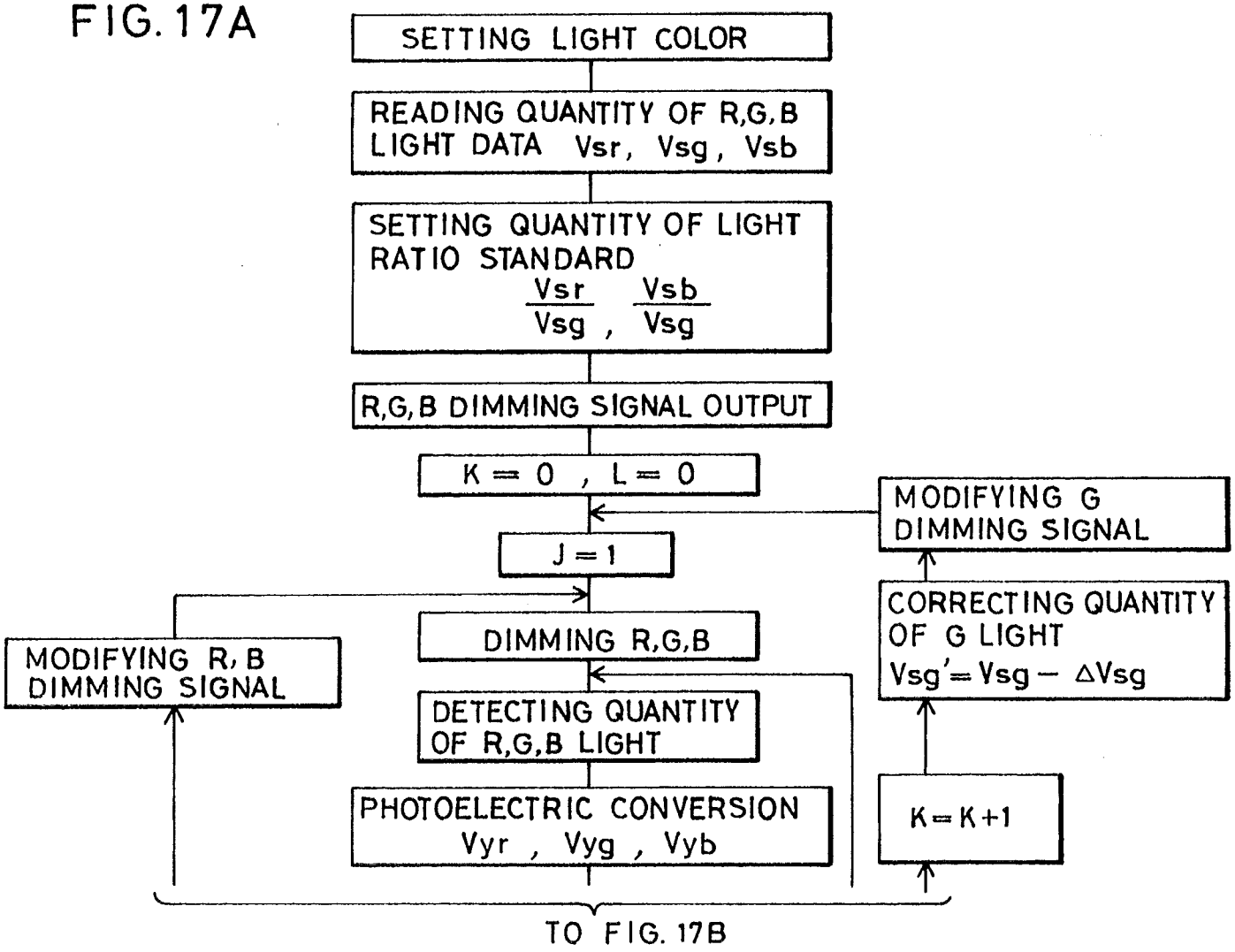
FIG. 17 consisting of the combination of FIGS. 17A and 17B is a flow-chart of the operation in still another embodiment of the present invention in which the luminaire of FIG. 15 is employed.
Figures 17, 17B:
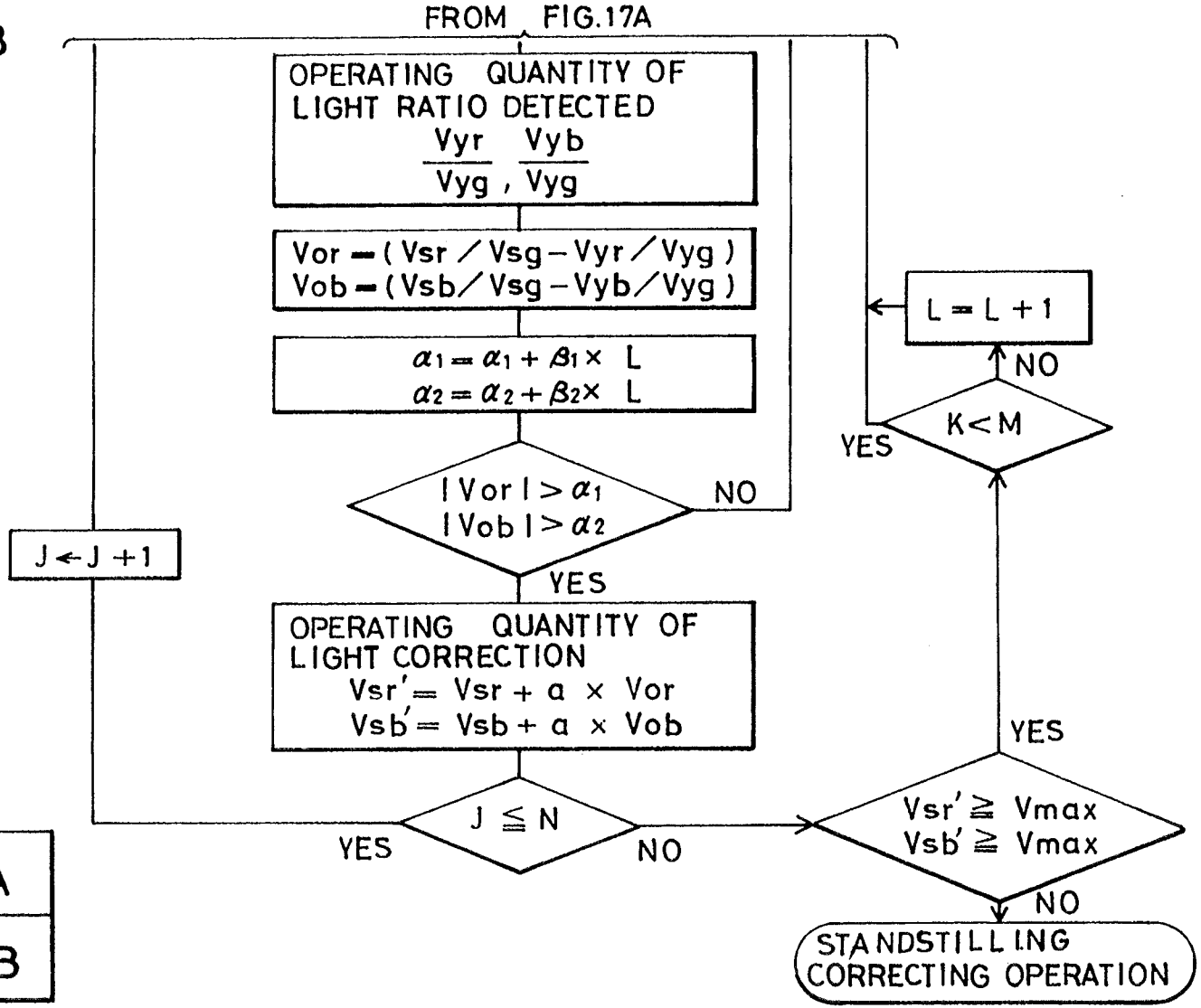

In FIG. 17, there is shown another embodiment in which the arrangement of FIG. 15 is utilized. In contrast to the embodiment of FIG. 15 in which the convergence discriminating value is enlarged in proportion to the enlargement of light reduction level of the quantity-of-light for G, the present embodiment is to enlarge the convergence discriminating value only when the frequency K of the quantity-of-light correction for G has exceeded a certain value M, and thereafter the value is enlarged upon every light reduction. With such controlling, it is intended to prevent the quantity-of-light of G from being lowered and, at the same time, to attain the regulation as precisely as possible at initial stages.

Figure 18A:
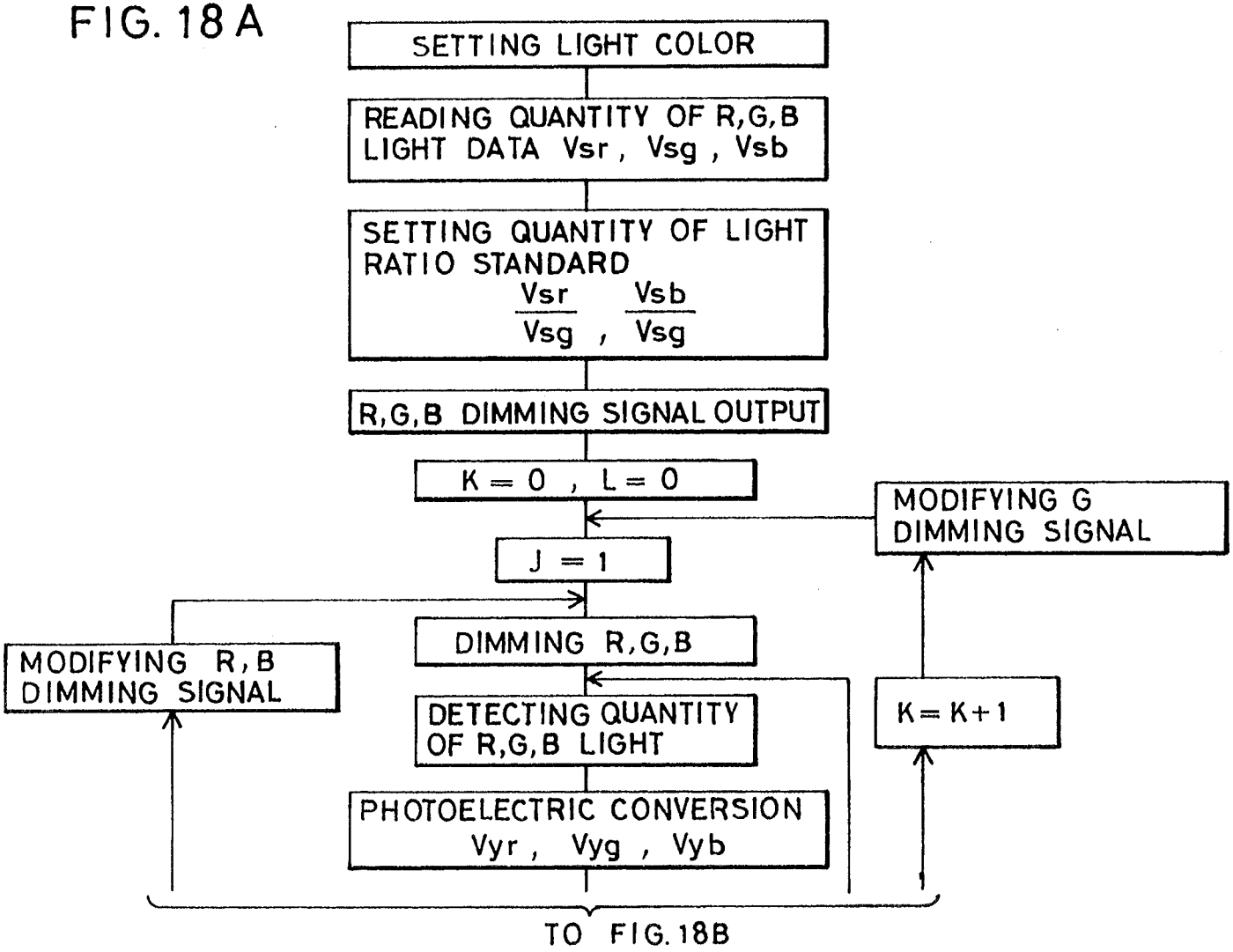
FIG. 18 consisting of the combination of FIGS. 18A and 18B is a flow-chart of the operation in another embodiment in which the luminaire of FIG. 15 is used.
Figures 18, 18B:
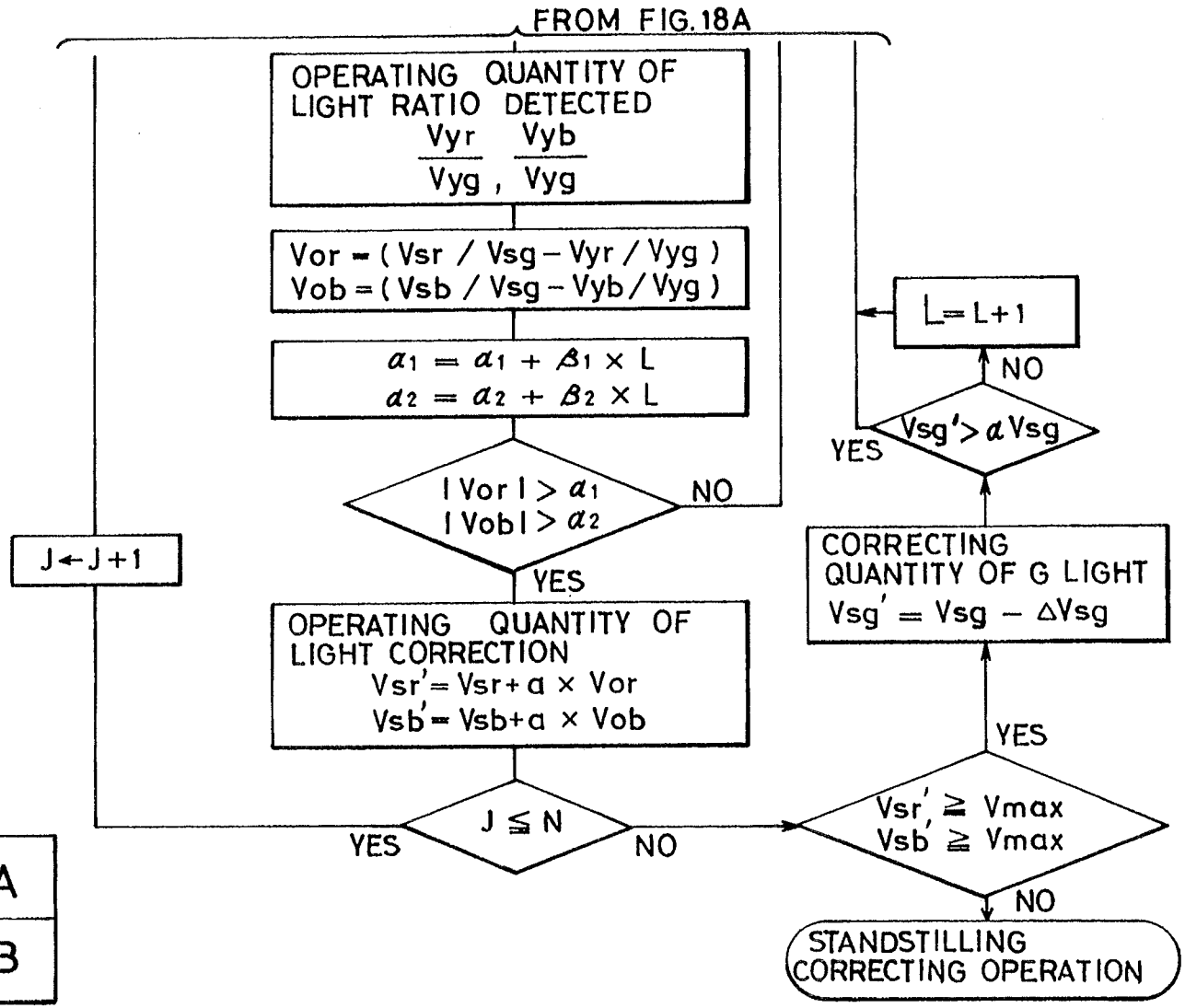

In FIG. 18, there is shown still another embodiment in which the arrangement of FIG. 15 is utilized. In the present embodiment, the convergence discriminating value is enlarged only when the quantity-of-light data $V_{sg}'$ of G has become below a certain value $(V_{sg}' \leqq V_{sg})$ and, thereafter, the value is increased every time when the light reduction takes place.

Figure 19A:
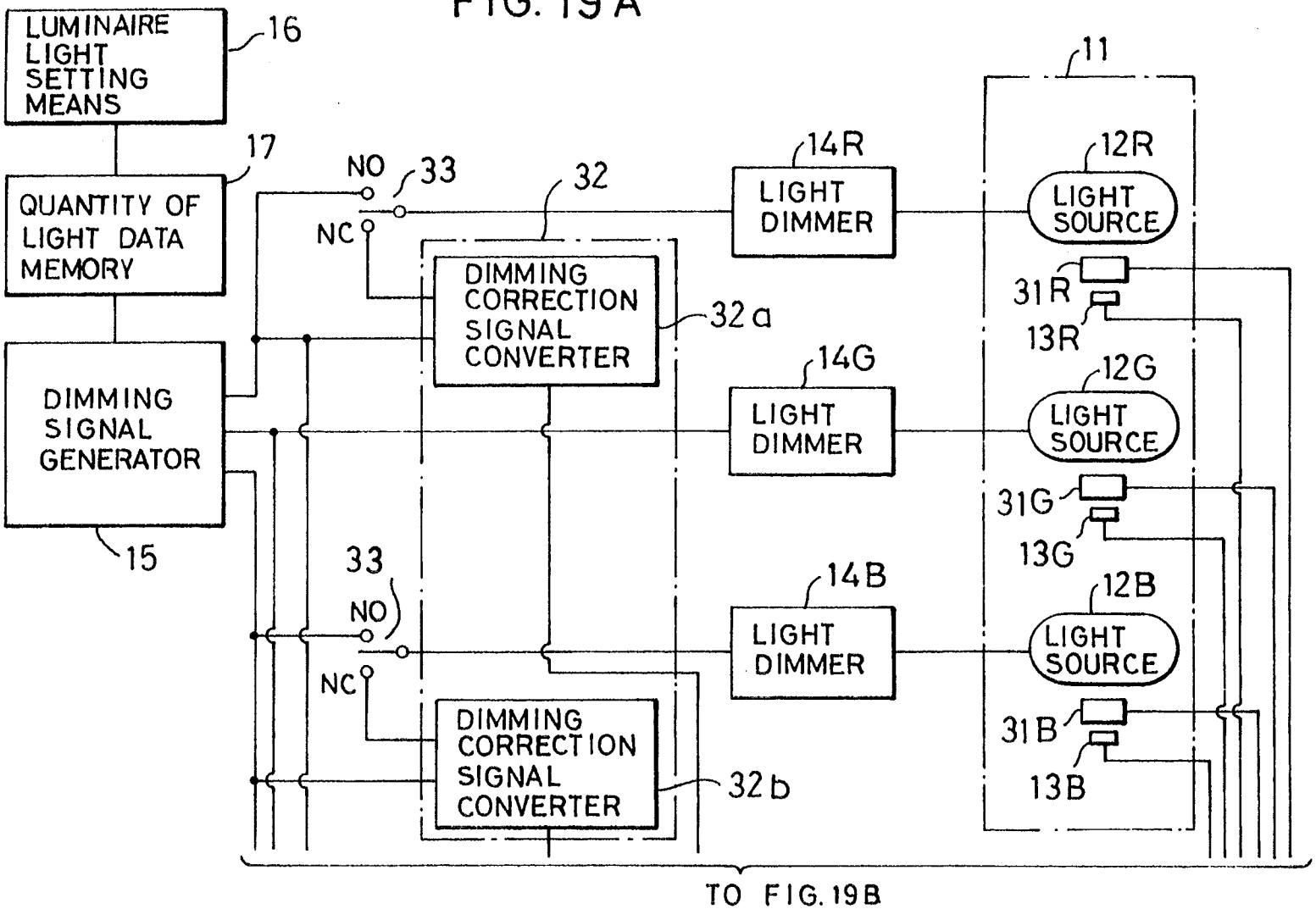
FIG. 19 consisting of the combination of FIGS. 19A and 19B is a block diagram showing a further embodiment of the luminaire according to the present invention.
Figures 19, 19B:
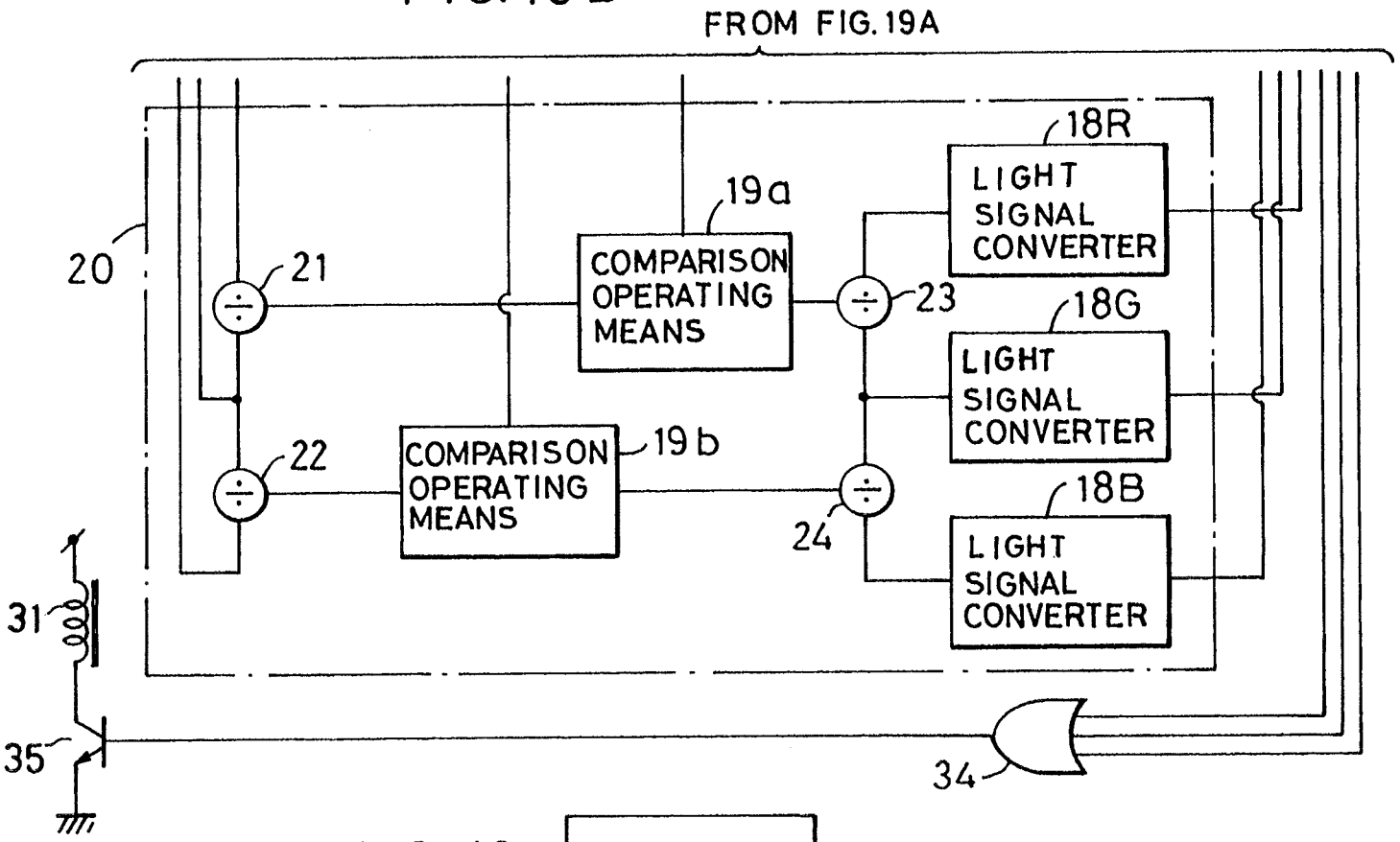

With respect to the foregoing arrangements, further, there is provided a measure for preventing any erroneous detection of the quantity-of-light due to a deposition of dust, foreign matter or the like to the quantity-of-light detectors. Referring here to FIG. 19, a still further embodiment of the present invention employing similar arrangement to the foregoing embodiments of FIG. 1 and others is shown. In the present embodiment, the presence of any foreign matter adjacent to the quantity-of-light detectors 13R, 13G and 13B is discriminated by foreign matter detectors 31R, 31G and 31B respectively comprising, for example, a photointerrupters, which are provided so that emitted light from the light sources 12R, 12G and 12B to the detectors 13R, 13G and 13B is blocked by the foreign matter if present on the surface of the detectors 13R, 13G and 13B, upon presence of which foreign matter the output of these detectors 31R, 31G and 31B will be at high level. When any one of the quantity-of-light detectors 13R, 13G and 13B is in such trouble, the thus provided output changes an output of an OR circuit 34 connected to the foreign matter detectors 31R, 31G and 31B from a low level to a high level, whereby a transistor 35 is turned ON to have a relay 31 excited to change its contacts **33*a* and 33*b* from normally closed (NC) side over to normally open (NO) side, the dimming correction signal converting means 32 is separated, and the quantity-of-light setting signals before being corrected and as provided out of the dimming signal converter 15 are input into the dimmers 14R, 14G and 14B. In an event of the absence of the foreign matter, the contacts 33*a* and 33*b* of the relay 31 are kept as connected to the NC side, and the dimming correction signal converting means 32 is interposed between the dimming signal converter 15 and the respective dimmers 14R, 14G and 14B. With such arrangement and operation, the quantity-of-light correction by the dimming correction signal converting means 32 can be executed in the event where the quantity-of-light detectors 13R, 13G and 13B are in normal state, whereas, upon presence of the foreign matter, the quantity-of-light correction by the dimming correction signal converting means 32** is stopped, to effectively prevent any color deviation from the predetermined blended color light.

Further, in the foregoing embodiments of FIGS. 5 to 19, all other arrangements and their functions than those referred to are the same as those in the embodiment of FIG. 1. While, further, the embodiments of FIGS. 5 to 19 do not show such members as the convergence discriminator 26 and so on, these members may be also effectively employed in such embodiments if occasion demands.

What is claimed is:

1. A variable color luminaire made variable in emission color and quantity-of-light of luminaire light, the luminaire comprising a plurality of light sources of different emission colors, means for dimming the quantity-of-light of respective said light sources, means for storing set quantity-of-light data of the respective light sources corresponding to the quantity-of-light for a blended color light, means for detecting the quantity-of-light of the respective light sources, an operating means for comparing detected quantity-of-light by said detecting means with a set quantity-of-light for each of the light sources, means for correcting the quantity-of-light of the respective light sources in accordance with results of said comparing operation at said comparison operating means, and a convergence discriminating means for discriminating if a ratio of said corrected quantity-of-light of the respective light sources is converged to a predetermined reference range for reproducing said blended color light and rendering said quantity-of-light correcting means to continue the correction until said discrimination of the convergence.

2. A variable color luminaire made variable in emission color and quantity-of-light of luminaire light, the luminaire comprising a plurality of light sources of different emission colors, means for dimming the quantity-of-light of respective said light sources, means for storing set data of the quantity-of-light of the respective light sources corresponding to the quantity-of-light for a blended color light, means for detecting the quantity-of-light of the respective light sources, an operating means for comparing the quantity-of-light detected by said detecting means with a set quantity-of-light for each of the light sources, means for correcting, when any one of the light sources has reached either one of upper and lower dimming limits, the quantity-of-light of other light sources in accordance with results of said comparing operation at said comparison operating means so that, when the lower dimming limit is reached by said one light source, the quantity-of-light of said other light sources is increased but, when the upper dimming limit is reached by said one light source, the quantity-of-light of said other light sources is reduced, and a convergence discriminating means for discriminating if a ratio of said corrected quantity-of-light of the respective light sources is converged to a predetermined reference range for reproducing said blended color light and rendering said correcting means to continue subjecting the quantity-of-light of the respective light sources to said correction until said discrimination of said covergence.

3. A variable color luminaire made variable in emission color and quantity-of-light of luminaire light, the luminaire comprising a plurality of light sources of different emission colors, means for dimming the quantity-of-light of respective said light sources, first means for storing the quantity-of-light data for determining dimming quantity of the quantity-of-light of the respective light sources, second means for storing data on set quantity-of-light with respect to the respective light sources corresponding to the quantity-of-light required for a blended color light, means for detecting the quantity-of-light of the respective light sources, first means for operating a comparison operation of said detected quantity-of-light of one optionally selected from said plural light sources with said detected quantity-of-light of the others, means for setting a reference quantity-of-light ratio for the respective light sources, second means for operating a comparison of a quantity-of-light ratio of said set and detected quantity-of-light from said first operating means with said reference quantity-of-light ratio from said setting means, means for correcting the quantity-of-light of the respective light sources other than said one optionally selected in accordance with results of said comparison at one operating means, and a convergence discriminating means for discriminating if a ratio of said corrected quantity-of-light of the respective light sources is converged to a predetermined reference range for for reproducing said blended color light and rendering said correcting means to continue subjecting the quantity-of-light of the respective light sources to said correction until said discrimination of said convergence.

4. The variable color luminaire according to claim 3, wherein said correcting means is provided, when a lower dimming limit is reached by any one of said light sources, for increasing the quantity-of-light of remaining other light sources.

5. The variable color luminaire according to claim 3, wherein said correcting means is provided, when an upper dimming limit is reached by any one of said light sources, for reducing the quantity-of-light of remaining other light sources.

6. The variable color luminaire according to claim 2, wherein said convergence discriminating means includes means for varying a convergence discriminating range in accordance with a level of the quantity-of-light of the light source being corrected.

7. The variable color luminaire according to claim 6, wherein said convergence discriminating range is provided for being set in accordance with a reduction level of the quantity-of-light of the light sources being reduced at said correcting means.

8. The variable color luminaire according to claim 7, wherein said convergence discriminating range is made larger as said reduction level of the quantity-of-light enlarges.

9. The variable color luminaire according to claim 7, wherein said convergence discriminating range is provided for being restrained from varying before a predetermined reduction level of the quantity-of-light is reached.

10. A variable color luminaire, which comprising:

a plurality of light sources of different emission colors, means for dimming the quantity-of-light of respective said light sources, means for storing set quantity-of-light data with respect to each of the light sources in correspondence with required quantity-of-light for a blended color light, means for detecting the quantity-of-light of the respective light sources, means for operating a comparison of said set quantity-of-light with said quantity-of-light detected at said detecting means with respect to the respective light sources, means for correcting, when any one of the light sources has reached a dimming limit, the quantity-of-light of remaining other light sources in accordance with results of said comparison at said operating means, a convergence discriminating means for discriminating if a ratio of said corrected quantity-of-light of the respective light sources is converged to a predetermined reference range for reproducing said blended color light and rendering said correcting means to continue subjecting the quantity-of-light of the respective light sources to said correction until said discrimination of said convergence, and means for stopping said correcting means when a level of said correction of the quantity-of-light has reached a predetermined value in a level of the correction.

11. The variable color luminaire according to claim 10, wherein said convergence discriminating means includes means for stopping, when a level of said correction of the quantity-of-light has reached a predetermined range, any sequential correction of the quantity-of-light.

12. The variable color luminaire according to claim 11, wherein means is provided adjacent to said quantity-of-light detecting means to receive said quantity-of-light detected by said detecting means for discriminating any abnormality, and said correction stopping means is actuated by an output of said abnormality discriminating means.

13. The variable color luminaire according to claim 12, wherein said abnormality discriminating means is provided for sending to said dimming means said set quantity-of-light data upon said discrimination of abnormality.

14. The variable color luminaire according to claim 12, wherein said abnormality discriminating means is provided for sending to said dimming means said quantity-of-light data so as not to light said light sources, upon said discimination of abnormality.

* * * * *